US007751730B2

(12) United States Patent
Kato et al.

(10) Patent No.: US 7,751,730 B2
(45) Date of Patent: Jul. 6, 2010

(54) DEVELOPING DEVICE, PROCESS UNIT, AND IMAGE FORMING APPARATUS DEVELOPER

(75) Inventors: Shinji Kato, Kanagawa (JP); Wakako Oshige, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 233 days.

(21) Appl. No.: 12/094,198

(22) PCT Filed: Sep. 13, 2007

(86) PCT No.: PCT/JP2007/068322

§ 371 (c)(1),
(2), (4) Date: May 19, 2008

(87) PCT Pub. No.: WO2008/035750

PCT Pub. Date: Mar. 27, 2008

(65) Prior Publication Data

US 2009/0257761 A1 Oct. 15, 2009

(30) Foreign Application Priority Data

Sep. 19, 2006 (JP) ..... 2006-253282
Jul. 18, 2007 (JP) ..... 2007-187035

(51) Int. Cl.
*G03G 15/08* (2006.01)

(52) U.S. Cl. ..... 399/30; 399/61; 399/62

(58) Field of Classification Search ..... 399/9, 399/24, 25, 27–30, 58, 61, 62, 107, 111, 399/119, 120, 252, 253, 256, 258, 262, 263
See application file for complete search history.

(56) References Cited

U.S. PATENT DOCUMENTS 5,231,452 A 7/1993 Murayama et al.
5,327,196 A 7/1994 Kato et al.
5,475,476 A 12/1995 Murai et al.
5,493,382 A 2/1996 Takagaki et al.
5,587,783 A * 12/1996 Nakamura et al. ..... 399/301
5,671,470 A 9/1997 Maruta et al.

(Continued)

FOREIGN PATENT DOCUMENTS

JP 63 189877 8/1988

(Continued)

OTHER PUBLICATIONS

U.S. Appl. No. 07/811,056, filed Dec. 20, 1991, Harasawa et al.

(Continued)

*Primary Examiner*—Hoan Tran
(74) *Attorney, Agent, or Firm*—Oblon, Spivak, McClelland, Maier & Neustadt, L.L.P.

(57) ABSTRACT

A black developer is conveyed in a first conveyance chamber in a rotation axis direction while agitating with rotation of a first screw member. A black-toner-concentration detecting sensor detects a toner concentration of the black developer by having contact with the black developer conveyed inside the first conveyance chamber. An average of peak amounts of a pressing force on the black developer, which is conveyed inside the first conveyance chamber by the first screw member, with respect to the black toner-concentration detecting sensor is set within a range of 9.8 15 [N/$m_2$] to 9.8 100 [N/$m_2$].

15 Claims, 12 Drawing Sheets

U.S. PATENT DOCUMENTS

| | | | | |
|---|---|---|---|---|
| 5,765,059 | A | 6/1998 | Kosuge et al. | |
| 5,860,038 | A | 1/1999 | Kato et al. | |
| 5,970,276 | A | 10/1999 | Kato | |
| 6,078,761 | A * | 6/2000 | de Waal | 399/61 |
| 6,081,678 | A | 6/2000 | Kato | |
| 6,195,519 | B1 | 2/2001 | Isobe et al. | |
| 6,389,245 | B2 * | 5/2002 | Shida et al. | 399/58 |
| 6,526,235 | B2 | 2/2003 | Kato | |
| 6,594,453 | B2 | 7/2003 | Kato | |
| 6,597,881 | B2 | 7/2003 | Hatori et al. | |
| 6,798,996 | B2 | 9/2004 | Sawada et al. | |
| 7,003,238 | B2 | 2/2006 | Yoshida et al. | |
| 7,024,133 | B2 | 4/2006 | Nagashima et al. | |
| 7,049,037 | B2 * | 5/2006 | Katoh et al. | 430/47.2 |
| 7,136,610 | B2 | 11/2006 | Arai et al. | |
| 7,190,912 | B2 | 3/2007 | Kato | |
| 7,203,433 | B2 | 4/2007 | Kato et al. | |
| 7,212,753 | B2 * | 5/2007 | Suzuki et al. | 399/27 |
| 7,228,081 | B2 | 6/2007 | Hasegawa et al. | |
| 7,251,420 | B2 | 7/2007 | Fujimori et al. | |
| 7,260,335 | B2 | 8/2007 | Kato et al. | |
| 7,305,203 | B2 | 12/2007 | Sampe et al. | |
| 7,343,132 | B2 | 3/2008 | Kimura et al. | |
| 2005/0013636 | A1 | 1/2005 | Sawai et al. | |
| 2006/0008296 | A1 | 1/2006 | Sampe et al. | |
| 2006/0018680 | A1 | 1/2006 | Hosokawa et al. | |
| 2006/0115292 | A1 | 6/2006 | Sampe et al. | |
| 2006/0120741 | A1 | 6/2006 | Murakami et al. | |
| 2006/0274628 | A1 | 12/2006 | Tanaka et al. | |
| 2007/0019976 | A1 | 1/2007 | Watanabe et al. | |
| 2007/0025748 | A1 | 2/2007 | Ishibashi et al. | |
| 2007/0036566 | A1 | 2/2007 | Takeuchi et al. | |
| 2007/0065164 | A1 | 3/2007 | Fujimori et al. | |
| 2007/0104499 | A1 | 5/2007 | Ariizumi et al. | |
| 2007/0110457 | A1 | 5/2007 | Kato et al. | |
| 2007/0116480 | A1 | 5/2007 | Takeuchi et al. | |
| 2007/0122168 | A1 | 5/2007 | Tanaka et al. | |
| 2007/0122169 | A1 | 5/2007 | Shimizu et al. | |
| 2007/0122171 | A1 | 5/2007 | Fujimori et al. | |
| 2007/0134014 | A1 | 6/2007 | Kato et al. | |

FOREIGN PATENT DOCUMENTS

| | | |
|---|---|---|
| JP | 6 308833 | 11/1994 |
| JP | 11 202610 | 7/1999 |
| JP | 11-288194 | 10/1999 |
| JP | 3308126 | 5/2002 |
| JP | 2003 295589 | 10/2003 |
| JP | 2003 307918 | 10/2003 |
| JP | 2005 164827 | 6/2005 |
| JP | 2006 258903 | 9/2006 |

OTHER PUBLICATIONS

U.S. Appl. No. 07/873,154, filed Apr. 24, 1992, Kanaya et al.

* cited by examiner

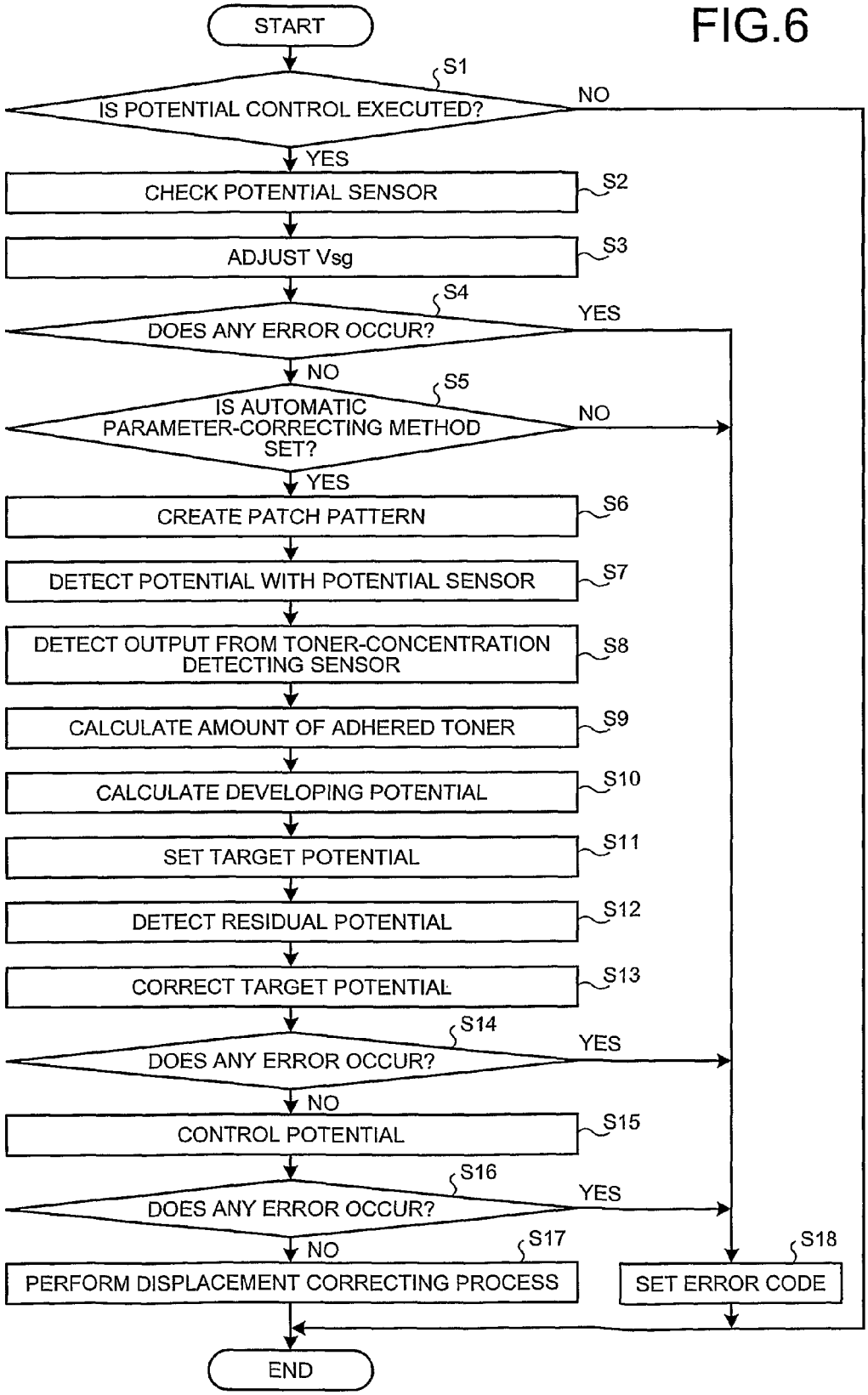
FIG.6
START
S1
IS POTENTIAL CONTROL EXECUTED?
NO
YES
CHECK POTENTIAL SENSOR
S2
ADJUST Vsg
S3
S4
DOES ANY ERROR OCCUR?
YES
NO
S5
IS AUTOMATIC PARAMETER-CORRECTING METHOD SET?
NO
YES
CREATE PATCH PATTERN
S6
DETECT POTENTIAL WITH POTENTIAL SENSOR
S7
DETECT OUTPUT FROM TONER-CONCENTRATION DETECTING SENSOR
S8
CALCULATE AMOUNT OF ADHERED TONER
S9
CALCULATE DEVELOPING POTENTIAL
S10
SET TARGET POTENTIAL
S11
DETECT RESIDUAL POTENTIAL
S12
CORRECT TARGET POTENTIAL
S13
S14
DOES ANY ERROR OCCUR?
YES
NO
CONTROL POTENTIAL
S15
S16
DOES ANY ERROR OCCUR?
YES
NO
S17
PERFORM DISPLACEMENT CORRECTING PROCESS
S18
SET ERROR CODE
END FIG.9
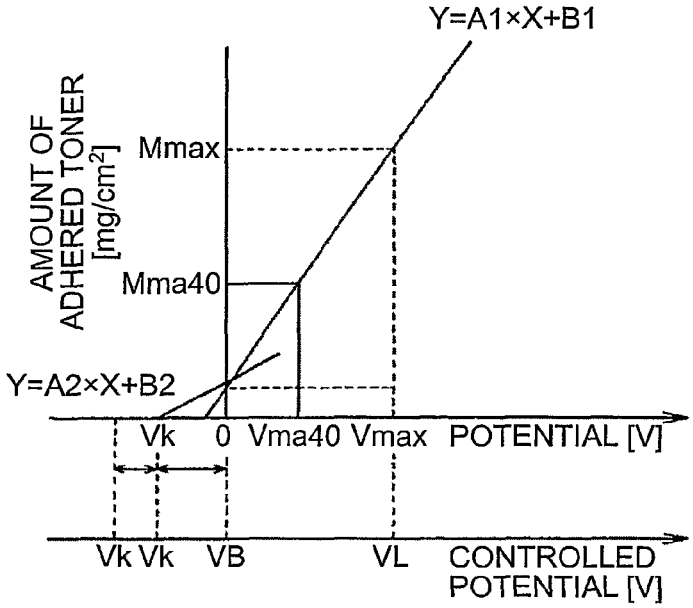
FIG.10
| NO. | Vmax | VD | VB | VL |
|---|---|---|---|---|
| 1 | 160 | 400 | 260 | 110 |
| 2 | 180 | 429 | 286 | 118 |
| 3 | 200 | 457 | 311 | 126 |
| 4 | 220 | 486 | 337 | 133 |
| 5 | 240 | 514 | 363 | 141 |
| ⋮ | ⋮ | ⋮ | ⋮ | ⋮ |
| 16 | 460 | 829 | 646 | 226 |
| 17 | 480 | 857 | 671 | 234 |
| 18 | 500 | 886 | 697 | 241 |
| 19 | 520 | 914 | 723 | 249 |
| 20 | 540 | 943 | 749 | 257 |
FIG.11
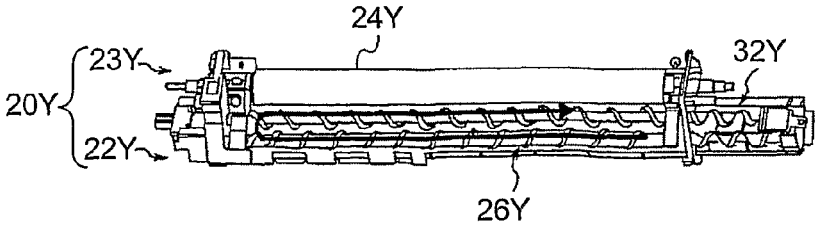

DEVELOPING DEVICE, PROCESS UNIT, AND IMAGE FORMING APPARATUS DEVELOPER

TECHNICAL FIELD

The present invention relates to a developer carrying device for use in an image forming apparatus.

BACKGROUND ART

A conventional developing device conveys a developer, which is conveyed by an agitation conveying member such as a screw member and held on a surface of a developer holding unit such as a developing sleeve, to an area facing a latent-image holding unit in accordance with a surface movement of the developer holding unit. Then, a toner included in the developer is transferred onto a latent image formed on the latent-image holding unit, so that the latent image is developed into a toner image. After developing the latent image, residual developer is returned to the agitation conveying member in the developing device in accordance with the surface movement of the developer holding unit. After that, as the developer is conveyed by the agitation conveying member, a toner concentration of the developer is detected by a toner-concentration detecting unit. Based on a result of the detection, the developer is refilled with an appropriate amount of a toner, and then supplied to the developer holding unit again.

Sometimes the amount of the toner included in the developer changes due to fluctuations in the environmental conditions and/or an amount of electric charge on the toner. As a result, a result of the detection by the toner-concentration detecting unit fluctuates even though the toner concentration has not changed which results into an erroneous detection. The erroneous detection can be prevented by pressing the developer firmly at a detecting position where the toner-concentration detecting unit detects the toner concentration so as to have the amount of the toner correspond to the toner concentration. For example, according to a technology disclosed in Japanese Patent Application Laid-open No. H06-308833, as in a graph of FIG. 10, by pressing 30 [g/cm$^2$] of a developer with a pressure of 9.88×300 N/m$^2$ or more, a result of a detection by a permeability sensor as the toner-concentration detecting unit can be kept constant regardless of the charge amount of the toner.

DISCLOSURE OF INVENTION

According to an aspect of the present invention, there is provided a developer conveying device includes a developer conveying unit configured to convey a developer containing a toner and a carrier in a rotation axis direction while agitating the developer with rotation of an agitation conveying member; and a toner-concentration detecting unit configured to detect a toner concentration of the developer by having contact with the developer conveyed inside the developer conveying unit or facing the developer via a wall of the developer conveying unit. An average of maximum amounts of a pressing force on the developer, which is conveyed inside the developer conveying unit by the agitation conveying member, by each one rotation of the agitation conveying member with respect to the toner-concentration detecting unit or an average of maximum amounts of a pressing force on the developer by each one rotation of the agitation conveying member with respect to a portion of the wall facing the toner-concentration detecting unit is set within a range of 9.8×15 [N/m$^2$] to 9.8×100 [N/m$^2$].

According to another aspect of the present invention, there is provided a developing device including a developer conveying device configured to convey a developer containing a toner and a carrier; and a developer holding unit configured to convey the developer conveyed by the developer conveying device to an area facing a latent-image holding unit in accordance with its own surface movement by holding the developer on its own endlessly-moving surface, and develop a latent image held by the latent-image holding unit. The developer conveying device being the above developer conveying device.

According to still another aspect of the present invention, there is provided a process unit that is integrally attached to a main body of an image forming apparatus including a latent-image holding unit configured to hold a latent image, a developing device configured to develop the latent image held on the latent-image holding unit, and a transfer unit configured to transfer a visualized image developed on the latent-image holding unit onto a transferred member. At least the latent-image holding unit and the developing device are held, as one unit, in a common holding unit of the process unit and the image forming apparatus. The developing device being the above developing device.

According to still another aspect of the present invention, there is provided an image forming apparatus including a latent-image holding unit configured to hold a latent image; and a developing device configured to develop the latent image held on the latent-image holding unit. The developing device being the above developing device.

BRIEF DESCRIPTION OF DRAWINGS

FIG. 6 is a flowchart for explaining a control flow of a parameter correcting process performed by a control unit shown in FIG. 5;

FIG. 9 is a graph for explaining data on a portion of a straight line indicated in the graph of the relation between the amount of adhered toner and the potential of a reference latent image;

FIG. 10 depicts an example of contents of a potential control table;

FIG. 11 is an exploded perspective view of a Y-color developing device shown in FIG. 3;

BEST MODE(S) FOR CARRYING OUT THE INVENTION

Figure 1:
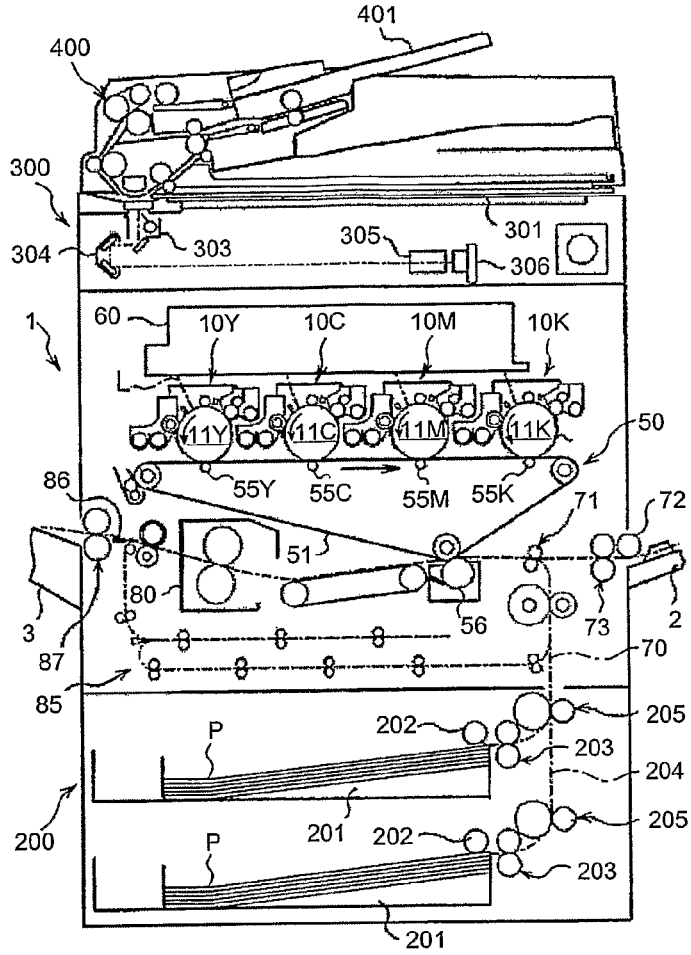
FIG. 1 is a schematic diagram of a copying machine according to an embodiment of the present invention.

The inventors found through experiments that, in an actual device, the permeability sensor does not always bring out such the output characteristics as shown in the graph shown in FIG. 10 of Japanese Patent Application Laid-Open No. 6-308833. Specifically, in a developing device disclosed in Japanese Patent Application Laid-Open No. 6-308833, a developer is conveyed in a rotation axis direction due to a rotation of a screw member as the agitation conveying member included in a developer conveying unit. Then, a toner concentration of the developer being conveyed is detected by the toner-concentration detecting unit fixed on a bottom wall of the developer conveying unit. In the downstream side of a toner-concentration detecting position of the toner-concentration detecting unit in a developer conveying direction, an inner wall of the developer conveying unit is finished in a coarse manner. Therefore, a conveying speed of the developer is slowed down at a portion of the inner wall finished in the coarse manner, so that the developer is pressed in the developer conveying direction at the toner-concentration detecting position located in the upstream side of the portion of the inner wall in the developer conveying direction. However, according to the experiment performed by the present inventors, in the configuration of the developing device describe above, the pressure applied to the developer in the developer conveying direction does not seem to be correlated well with the result of the detection by the toner-concentration detecting unit including the permeability sensor.

The inventors performed further experiments, and found the reason why the correlation between the pressure applied to the developer in the developer conveying direction and the result of the detection by the toner-concentration detecting unit does not result in a preferable outcome. A certain degree of a clearance is provided between a wall of the developer conveying unit including the screw member and a spiral blade of the screw member. A detectable distance range of the toner-concentration detecting unit, which is fixed on the wall of the developer conveying unit, is relatively short, so that the toner-concentration detecting unit cannot detect the toner concentration of the developer in the spiral blade located relatively far from the toner-concentration detecting unit. The toner-concentration detecting unit can detect the toner concentration of the developer in the clearance located near the sensor. Therefore, the developer in the clearance needs to be pressed sufficiently. However, the pressing force in the rotation axis direction (the conveying direction) in accordance with the rotation of the screw member is mainly exerted on the developer contained in the spiral blade of the screw member. Even if the developer contained in the spiral blade is sufficiently pressed, the pressing force may not reach the developer in the clearance outside the spiral blade. This is the reason why the correlation between the pressure applied to the developer in the developer conveying direction and the result of the detection by the toner-concentration detecting unit does not result in a preferable outcome.

Furthermore, the present inventors found that there is a problem in the configuration employing the agitation conveying member such as the screw member that conveys the developer in the rotation axis direction with its own rotation. Namely, unless the developer is pressed on a surface of the permeability sensor or a bottom wall of a developer containing unit, which is located between the developer and the permeability sensor, by sufficient pressure in accordance with the rotation of the agitation conveying member, the developer cannot be properly shuffled near the permeability sensor. Consequently, the toner concentration of the developer stagnated near the permeability sensor for a long time is continuously detected, so that a change of the toner concentration of the developer cannot be detected promptly.

In accordance with the above situation, an object of the present invention is to provide a developer conveying device capable of preventing an occurrence of an erroneous detection of the toner concentration due to a fluctuation in the toner bulk and detecting a change of the toner concentration promptly, and also a developing device, a process unit, and an image forming apparatus that include the developer conveying device.

Exemplary embodiments of the present invention are explained in detail below with reference to the accompanying drawings.

FIG. 1 is a schematic diagram of a copying machine according to an embodiment of the present invention. The copying machine includes a printer unit 1, a paper feeding device 200, a scanner 300, an automatic document feeder (hereinafter, "ADF") 400. The printer unit 1 forms an image on a sheet of recording paper P. The paper feeding device 200 feeds the recording paper P to the printer unit 1. The scanner 300 scans a surface of a document (original). The ADF 400 automatically feeds a document to the scanner 300.

In the scanner 300, a document (not shown) put on an exposure glass 301 is scanned by reciprocating movements of a first scanning unit 303 including a light source for illuminating the document, a mirror, and the like and a second scanning unit 304 including a plurality of reflecting mirrors. A scanning light emitted from the second scanning unit 304 is focused on an imaging surface of a reading sensor 306, which is located in front of an imaging lens 305, by the imaging lens 305. Then, the focused scanning light is read as an image signal by the reading sensor 306.

On one side of an enclosure of the printer unit 1, there is provided a manual paper-feeding tray 2 on which the recording paper P to be fed inside the enclosure is put manually. On other side of the enclosure, there is provided a copy receiving tray 3 on which image-formed recording paper P ejected from the enclosure is stacked.

Figure 2:
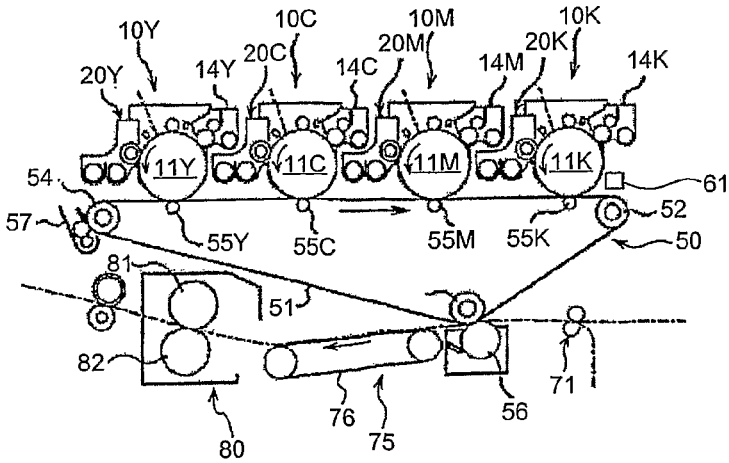
FIG. 2 is a partial enlarged diagram for explaining an internal structure of a printer unit in the copying machine shown in FIG. 1.

FIG. 2 is a partial enlarged schematic diagram for explaining an internal structure of the printer unit 1. Inside the enclosure of the printer unit 1, a transfer unit 50 in which a loop intermediate transfer belt 51 as a transferred unit is strained by a plurality of straining rollers is arranged. The intermediate transfer belt 51 is made of a material having poor stretching force of polyimide resin dusted with carbon powder for adjusting an electric resistance. The intermediate transfer belt 51 is endlessly rotated clockwise in accordance with a rotation of a driving roller 52 by being strained by the driving roller 52, which is driven to rotate clockwise in the drawing by a drive unit (not shown), a secondary transfer back-up roller 53, a driven roller 54, and four primary transfer rollers 55Y, 55C, 55M, and 55K. Incidentally, additional characters "Y", "C", "M", and "K" those assigned to the primary transfer rollers 55 denote "yellow", "cyan", "magenta", and "black" colors respectively. The same could be said of additional characters "Y", "C", "M", and "K" those assigned to other members.

The intermediate transfer belt 51 is curved sharply at portions where the driving roller 52, the secondary transfer back-up roller 53, and the driven roller 54 strain the intermediate transfer belt 51, and thereby having an inverted triangular shape which base faces upwards in a vertical direction. A strained upper portion of the intermediate transfer belt 51 corresponding to the base of the inverted triangular shape extends in a horizontal direction. Four process units 10Y, 10C, 10M, and 10K are horizontally-aligned on the strained upper portion of the intermediate transfer belt 51 along an extending direction of the strained upper portion.

As shown in FIG. 1, an optical writing unit 60 is arranged above the four process units 10Y, 10C, 10M, and 10K. Based on image data on a document scanned by the scanner 300, the optical writing unit 60 is driven to emit four writing lights L by four semiconductor lasers (not shown) those controlled by a laser control unit (not shown). Then, drum-shaped photoreceptors 11Y, 11C, 11M, and 11K, as latent-image holding units for the process units 10Y, 10C, 10M, and 10K, are respectively scanned by the writing lights L in the dark, so that electrostatic latent images for Y, C, M, and K colors are respectively written on surfaces of the photoreceptors 11Y, 11C, 11M, and 11K.

According to the present embodiment, there is used the optical writing unit 60 capable of optical-scanning in such a manner that a laser beam emitted from the semiconductor laser is deflected by a polygon mirror (not shown), and the deflected laser beam is reflected to an object to be scanned by a reflecting mirror (not shown) or through an optical lens. Alternatively, the optical-scanning can be performed by using an LED (light-emitting diode) array.

Figure 3:
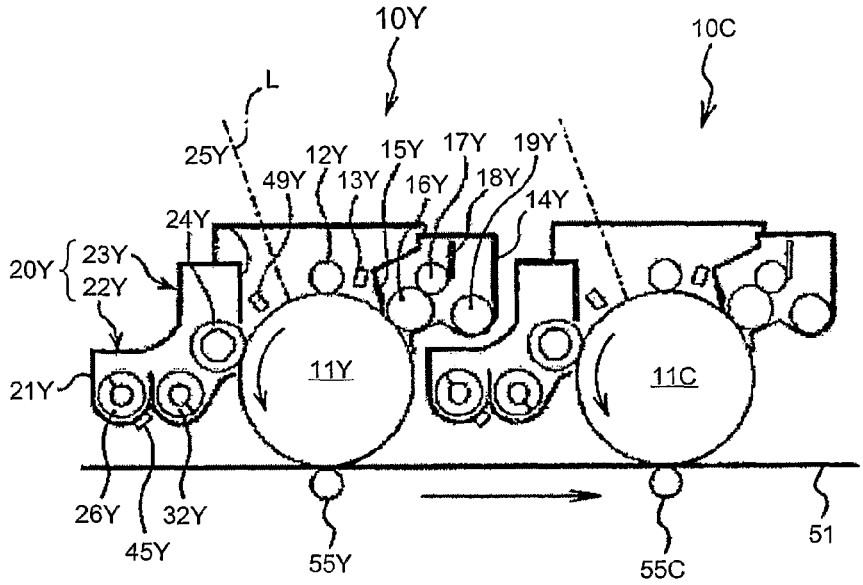
FIG. 3 is an enlarged view of process units for yellow (Y) and cyan (C) colors and an intermediate transfer belt shown in FIG. 2.

FIG. 3 is an enlarged view of the process units 10Y and 10C and the intermediate transfer belt 51. The process unit 10Y includes a charging member 12Y, a discharging device 13Y, a drum cleaning device 14Y, a developing device 20Y as a developing unit, a potential sensor 49Y, and the like, those arranged around the drum-shaped photoreceptor 11Y and held in a casing as a common holding unit, and also removably-attached to the printer unit as one unit in an integrated manner.

The charging member 12Y is a roller-like member that is rotatably supported by a bearing (not shown) with having contact with the photoreceptor 11Y. A charging bias is applied to the charging member 12Y by a bias supplying unit (not shown), so that the charging member 12Y rotates with having contact with the photoreceptor 11Y. As a result, a surface of the photoreceptor 11Y is uniformly charged, for example, to the same polarity as the charging polarity of Y-toner. Instead of such the charging member 12Y, it is also possible to employ a scorotron charger capable of uniformly-charging the photoreceptor 11Y without having contact with the photoreceptor 11Y.

The developing device 20Y in which a Y-developer containing a magnetic carrier (not shown) and a non-magnetic Y-toner (not shown) is contained in a casing 21Y includes a developer conveying device 22Y and a developing unit 23Y. In the developing unit 23Y, a portion of a perimeter surface of a developing sleeve 24Y as a developer holding unit which surface is endlessly moved by being driven to rotate by a driving unit (not shown) is exposed through an opening provided on the casing 21Y. Consequently, a developing area is formed between the photoreceptor 11Y and the developing sleeve 24Y those facing to each other by keeping a predetermined space.

Inside the developing sleeve 24Y made of a non-magnetic hollow pipe member, so that the magnetic roller, a magnetic roller (not shown) including a plurality of magnetic poles aligned in a circumferential direction is fixed on the developing sleeve 24Y not to move in accordance with a movement of the developing sleeve 24Y. The developing sleeve 24Y dips out the Y-developer from inside the developer conveying device 22Y in such a manner that the developing sleeve 24Y is driven to rotate with adsorbing the Y-developer inside the developer conveying device 22Y onto its surface due to the action of a magnetic force of the magnetic roller. Then, the Y-developer conveyed to the developing area in accordance with the rotation of the developing sleeve 24Y enters into 0.9 [mm] of a doctor gap formed between a doctor blade 25Y and a surface of the sleeve. A tip of the doctor blade 25Y faces to the surface of the developing sleeve 24Y by keeping a predetermined space. At this time, a thickness of a layer on the sleeve is controlled to be at 0.9 [mm] or less. Then, when the Y-developer is conveyed near the developing area facing the photoreceptor 11Y in accordance with the rotation of the developing sleeve 24Y, a chain formation occurs on the sleeve due to a magnetic force of a developing pole (not shown) of the magnetic roller, so that a magnetic brush is formed thereon.

A developing bias having, for example, the same polarity as the charging polarity of the toner is applied to the developing sleeve 24Y by the bias supplying unit (not shown). Therefore, in the developing area, a non-developing potential, which causes the Y-toner to electrostatically move from the non-image area side to the sleeve side, acts between the surface of the developing sleeve 24Y and a non-image area (a uniformly-charged area, i.e., a background area) of the photoreceptor 11Y. Also, a developing potential, which causes the Y-toner to electrostatically move from the sleeve side towards an electrostatic latent image, acts between the surface of the developing sleeve 24Y and the electrostatic latent image formed on the photoreceptor 11Y. The Y-toner included in the Y-developer is transferred onto the electrostatic latent image by the action of the developing potential, so that the electrostatic latent image on the photoreceptor 11Y is developed into a Y-toner image.

The Y-developer passed through the developing area in accordance with the rotation of the developing sleeve 24Y is affected by a repulsive magnetic-field formed between the repulsive magnetic poles included in the magnetic roller (not shown), and then moves back from the developing sleeve 24Y to inside the developer conveying device 22Y.

The developer conveying device 22Y includes a first screw member 26Y, a second screw member 32Y, a partition wall provided between the first and second screw members, a Y-toner-concentration detecting sensor 45Y including a permeability sensor, and the like. A first conveyance chamber where the first screw member 26Y is contained and a second conveyance chamber where the second screw member 32Y is contained, those as a developer conveying unit, are partitioned by the partition wall. However, in an area where both ends of each of the screw members in an axis direction are faced to each other, the first and second conveyance chambers are communicated with each other via an opening (not shown).

Each of the first and second screw members 26Y and 32Y, as an agitation conveying member, includes a stick-like rotating shaft member which both ends are rotatably supported by bearings (not shown) and a spiral blade provided in a spirally-protruding manner on a perimeter surface of the rotating shaft member. The Y-developer is conveyed in a rotation axis direction by the spiral blade that is driven to rotate by a driving unit (not shown).

In the first conveyance chamber where the first screw member 26Y is contained, the Y-developer is conveyed from the front side to the back side in a direction perpendicular to a sheet of the drawing as the first screw member 26Y is driven to rotate. Then, when the Y-developer is conveyed near an end of the casing 21Y in the back side, the Y-developer enters into the second conveyance chamber via the opening (not shown) provided on the partition wall.

In the upper side of the second conveyance chamber where the second screw member 32Y is contained, the developing unit 23Y is formed. The second conveyance chamber and the developing unit 23Y are communicated with each other in a whole area of a portion where the second conveyance chamber and the developing unit 23Y are faced to each other. Therefore, the second screw member 32Y and the developing sleeve 24Y arranged obliquely-upward from the second screw member 32Y are faced to each other by keeping in a parallel manner. In the second conveyance chamber, the Y-developer is conveyed from the back side to the front side in the direction perpendicular to the sheet of the drawing as the second screw member 32Y is driven to rotate. During the progress of the conveyance, the Y-developer around the second screw member 32Y in a rotating direction is dipped out by the developing sleeve 24Y arbitrarily, or the Y-developer after completion of the development is collected from the developing sleeve 24Y arbitrarily. Then, the Y-developer conveyed near an end of the second conveyance chamber in the front side in the drawing returns back to the first conveyance chamber via the opening (not shown) provided on the partition wall.

The Y-toner-concentration detecting sensor 45Y, as a toner-concentration detecting unit, including the permeability sensor is fixed on a bottom wall of the first conveyance chamber. A toner concentration of the Y-developer conveyed by the first screw member 26Y is detected from downwards by the Y-toner-concentration detecting sensor 45Y, and a voltage corresponding to a result of the detection is output. Based on the output voltage from the Y-toner-concentration detecting sensor 45Y, the control unit (not shown) drives a Y-toner refilling device (not shown) if necessary to refill an appropriate amount of Y-toner to inside the first conveyance chamber. Consequently, the toner concentration of the Y-developer, which is degraded due to the development, is recovered.

The Y-toner image formed on the photoreceptor 11Y is primarily transferred onto the intermediate transfer belt 51 by a primary transfer nip for Y color, which is described later. On the surface of the photoreceptor 11Y after processing the primary transfer of the Y-toner image, transfer residue toner that is not primarily transferred onto the intermediate transfer belt 51 is adhered.

The drum cleaning device 14Y supports a cleaning blade 15Y, which is made of, for example, a polyurethane rubber and the like, in a cantilever manner. In the free end side, the drum cleaning device 14Y has contact with the surface of the photoreceptor 11Y. A brush-tip side of a brush roller 16Y also has contact with the photoreceptor 11Y. The brush roller 16Y includes a rotating shaft member, which is driven to rotate by a driving unit (not shown), and a large number of conductive raised bristles, which is arranged on a perimeter surface of the rotating shaft member in a standing manner. The transfer residue toner is scraped away from the surface of the photoreceptor 11Y by the cleaning blade 15Y and the brush roller 16Y. A cleaning bias is applied to the brush roller 16Y via a metallic electric-field roller 17Y having contact with the brush roller 16Y. A tip of a scraper 18Y is pressed on the electric-field roller 17Y. After the transfer residue toner scraped away from the photoreceptor 11Y by the cleaning blade 15Y and the brush roller 16Y is passed through the brush roller 16Y and the electric-field roller 17Y, the transfer residue toner is further scraped away from the electric-field roller 17Y by the scraper 18Y, and then dropped onto a collecting screw 19Y. Then, the transfer residue toner is ejected from the casing as the collecting screw 19Y is driven to rotate, and returned back to inside the developer conveying device 22Y via a toner-recycle conveying unit (not shown).

The surface of the photoreceptor 11Y that the transfer residue toner is cleaned up by the drum cleaning device 14Y is discharged by the discharging device 13Y including a discharge lamp and the like, and uniformly charged again by the charging member 12Y.

A potential of the non-image area of the photoreceptor 11Y after passing through an optical writing position of the writing light L is detected by the potential sensor 49Y, and a result of the detection is output to the control unit (not shown).

The photoreceptor 11Y having 60 [mm] of a diameter is driven to rotate at 282 [mm/sec] of the linear speed. The developing sleeve 24Y having 25 [mm] of a diameter is driven to rotate at 564 [mm/sec] of the linear speed. A charge amount of the toner included in the developer to be supplied to the developing area is set within the range of approximately −10 to 30 [μC/g]. A developing gap that is a space between the photoreceptor 11Y and the developing sleeve 24Y is set within the range of 0.5 to 0.3 mm. A thickness of a photosensitive layer of the photoreceptor 11Y is set at 30 [μm]. A spot diameter of a beam of the writing light L on the photoreceptor 11Y is set at 50×60 [μm], and a light intensity of the beam is set at approximately 0.47 [mW]. A uniformly-charged potential of the photoreceptor 11Y is set, for example, at −700 [V], and a potential of the electrostatic latent image is set at −120 [V]. A voltage of the developing bias is set, for example, at −470 [V], and 350 [V] of the developing potential is secured.

The process unit 10Y is explained in detail above, but the other process units 10C, 10M, and 10K have the same configuration as that is of the process unit 10Y except for a toner color to be used.

As shown in FIG. 2, each of the photoreceptors 11Y, 11C, 11M, and 11K respectively in the process units 10Y, 10C, 10M, and 10K rotates by having contact with the strained upper surface of the intermediate transfer belt 51 that is endlessly moved clockwise, and thereby forming a primary transfer nip for Y, C, M, or K color. In the back side of the primary transfer nips for Y, C, M, and K colors, the primary transfer rollers 55Y, 55C, 55M, and 55K have contact with a rear surface of the intermediate transfer belt 51. A primary transfer bias which polarity is opposite to the charging polarity of the toner is applied to each of the primary transfer rollers 55Y, 55C, 55M, and 55K by the bias supplying unit (not shown). By the application of the primary transfer bias, a primary transfer electric-field, which causes the toner to electrostatically move from the photoreceptor side to the belt side, is formed on each of the primary transfer nips for Y, C, M, and K colors. When toner images for Y, C, M, and K colors, which are formed on the photoreceptors 11Y, 11C, 11M, and 11K respectively, enter into the primary transfer nips for Y, C, M, and K colors in accordance with the rotations of the photoreceptors 11Y, 11C, 11M, and 11K, the toner images are sequentially overlapped and primarily transferred onto the intermediate transfer belt 51 by the actions of the primary transfer electric-field and the nip pressure. Consequently, a four-color overlapped toner image (hereinafter, referred to as a "four-color toner image") is formed on the front surface (an outer circumferential loop surface) of the intermediate transfer belt 51. Alternatively, a conductive brush to which the primary transfer bias is applied, a non-contact corona charger, or the like can be employed instead of the primary transfer rollers 55Y, 55C, 55M, and 55K.

Figure 4:
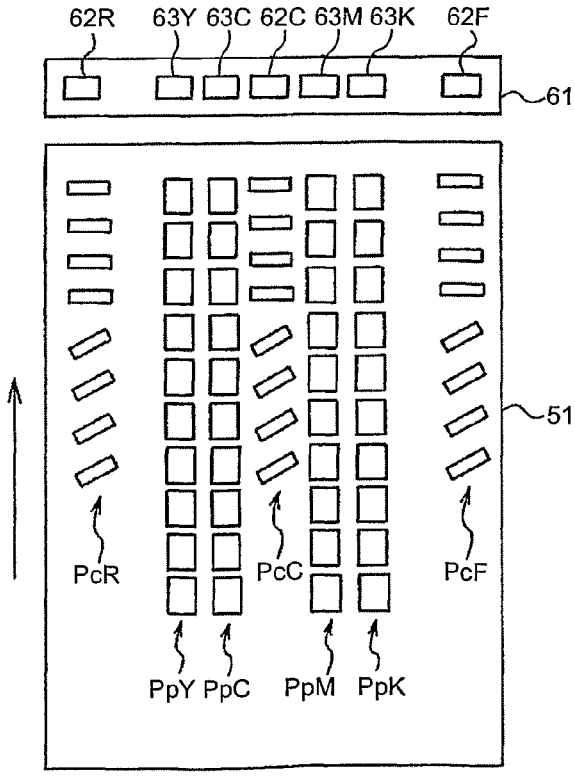
FIG. 4 is a plane view of an optical sensor unit and the intermediate transfer belt shown in FIG. 2.

In the right side of the process unit 10K in the drawing, an optical sensor unit 61 is arranged to face to the front surface of the intermediate transfer belt 51 by keeping a predetermined space between them. The optical sensor unit 61 includes, as shown in FIG. 4, a rear-side-position detecting sensor 62R, an image-density detecting sensor 63Y, an image-density detecting sensor 63C, a center-position detecting sensor 62C, an image-density detecting sensor 63M, an image-density detecting sensor 63K, and a front-side-position detecting sensor 62F, those aligned in a width direction of the intermediate transfer belt 51. Each of the sensors includes a reflective photosensor. A light emitted from a light-emitting element (not shown) is reflected on the front surface of the intermediate transfer belt 51 or the toner image formed on the belt, and an amount of the reflected light is detected by a light-receiving element (not shown). Based on an output voltage from each of the sensors, the control unit (not shown) can detect a position of the toner image formed on the intermediate transfer belt 51 or an image density of the toner image (an amount of adhered toner per unit area).

As shown in FIG. 2, a secondary transfer roller 56 is arranged below the intermediate transfer belt 51. The secondary transfer roller 56 is driven to rotate counterclockwise in the drawing by a drive unit (not shown) by having contact with the front surface of the intermediate transfer belt 51, and thereby forming a secondary transfer nip. In the back side of the secondary transfer nip, the electrically-grounded secondary transfer back-up roller 53 drives the intermediate transfer belt 51 to rotate.

A secondary transfer bias which polarity is opposite to the charging polarity of the toner is applied to the secondary transfer roller 56 by the bias supplying unit (not shown). By the application of the secondary transfer bias, a secondary transfer electric-field is formed between the secondary transfer roller 56 and the electrically-grounded secondary transfer back-up roller 53. The four-color toner image formed on the front surface of the intermediate transfer belt 51 enters into the secondary transfer nip in accordance with the endless movement of the intermediate transfer belt 51.

As shown in FIG. 1, the paper feeding device 200 includes a plurality of sets of a paper feeding cassette 201, a paper feeding roller 202, a pair of separation rollers 203, a pair of paper conveying rollers 205, and the like. The paper feeding cassette 201 stores therein the recording paper P. The paper feeding roller 202 feeds the recording paper P stored in the paper feeding cassette 201 out of the cassette. The pair of separation rollers 203 separates the fed recording paper P into each single sheet. The pair of paper conveying rollers 205 conveys the separated recording paper P along a feed-out path 204. The paper feeding device 200 is, as shown in the drawing, arranged just beneath the printer unit 1. The feed-out path 204 in the paper feeding device 200 is communicated with a paper feeding path 70 in the printer unit 1, so that the recording paper P fed out from the paper feeding cassette 201 in the paper feeding device 200 is conveyed to the paper feeding path 70 in the printer unit 1 via the feed-out path 204.

A pair of registration rollers 71 is arranged near an end of the paper feeding path 70 in the printer unit 1. The recording paper P sandwiched between the registration rollers 71 is fed into the secondary transfer nip at a timing synchronized with the four-color toner image formed on the intermediate transfer belt 51. At the secondary transfer nip, the four-color toner image formed on the intermediate transfer belt 51 is secondarily batch-transferred onto the recording paper P by the actions of the secondary transfer electric-field and the nip pressure. The secondarily batch-transferred four-color toner image is combined with a while color of the recording paper P, and thereby forming a full-color image. The recording paper P on which the full-color image is formed is ejected from the secondary transfer nip, and detached away from the intermediate transfer belt 51.

In the left side of the secondary transfer nip in the drawing, a conveyor belt unit 75 in which a loop paper-conveying belt 76 is strained by a plurality of straining rollers and endlessly moved counterclockwise in the drawing is arranged. The recording paper P detached away from the intermediate transfer belt 51 is passed onto a strained upper surface of the paper-conveying belt 76, and conveyed to a fixing device 80.

The recording paper P conveyed inside the fixing device 80 is held by a fixing nip formed by a heating roller 81 and a pressure roller 82. The heating roller 81 contains a heat source such as a halogen lamp (not shown). The pressure roller 82 is pressed on the heating roller 81. While the full-color image is fixed on the recording paper P by the application of pressure and heat, the recording paper P is being conveyed towards outside the fixing device 80.

A slight amount of secondary-transfer residue toner that is not transferred onto the recording paper P is adhered on the surface of the intermediate transfer belt 51 after the recording paper P is passed through the secondary transfer nip. The secondary-transfer residue toner is removed from the belt by a belt cleaning device 57 having contact with the front surface of the intermediate transfer belt 51.

As shown in FIG. 1, a switchback device 85 is arranged below the fixing device 80. When the recording paper P ejected from the fixing device 80 is conveyed at a conveying-path switching position where a conveying path of the recording paper P is switched by a swingable switching claw 86, the recording paper P is conveyed to either a side of a pair of paper ejecting rollers 87 or a side of the switchback device 85 depending on a stop-swinging position of the switching claw 86. When the recording paper P is conveyed towards the paper ejecting rollers 87, the recording paper P is ejected out of the machine, and stacked on the copy receiving tray 3.

On the other hand, when the recording paper P is conveyed towards the switchback device 85, the recording paper P is turned upside down due to a switchback conveyance performed by the switchback device 85, and conveyed towards the registration rollers 71 again. Then, the recording paper P enters into the secondary transfer nip again, and the full-color image is formed on the other side of the recording paper P.

When the recording paper P is manually fed from the manual paper-feeding tray 2 provided on the side surface of the enclosure of the printer unit 1, the recording paper P is conveyed towards the registration rollers 71 via a manual paper-feeding roller 72 and a pair of manual separation rollers 73. The registration rollers 71 can be grounded, or biased to remove a paper powder of the recording paper P.

In a case of making a copy of an original document by using the copying machine according to the present embodiment, at first, the document is set on an original document tray 401 of the ADF 400. Alternatively, the ADF 400 is opened up, and the document can be set on the exposure glass 301 of the scanner 300, and then the ADF 400 is closed down to hold the document. When the document is set on the original document tray 401 of the ADF 400, when a "START" switch (not shown) is pressed, the document is fed onto the exposure glass 301. Then, the scanner 300 is driven to scan, i.e., the first scanning unit 303 and the second scanning unit 304 start reading and scanning the document. At almost the same time, the transfer unit 50 and the process units 10Y, 10C, 10M, and 10K start being driven. Also, the recording paper P starts being fed out from the paper feeding device 200. When the recording paper P that is not set in the paper feeding cassette 201 is used, the recording paper P set on the manual paper-feeding tray 2 is fed out.

Figure 5:
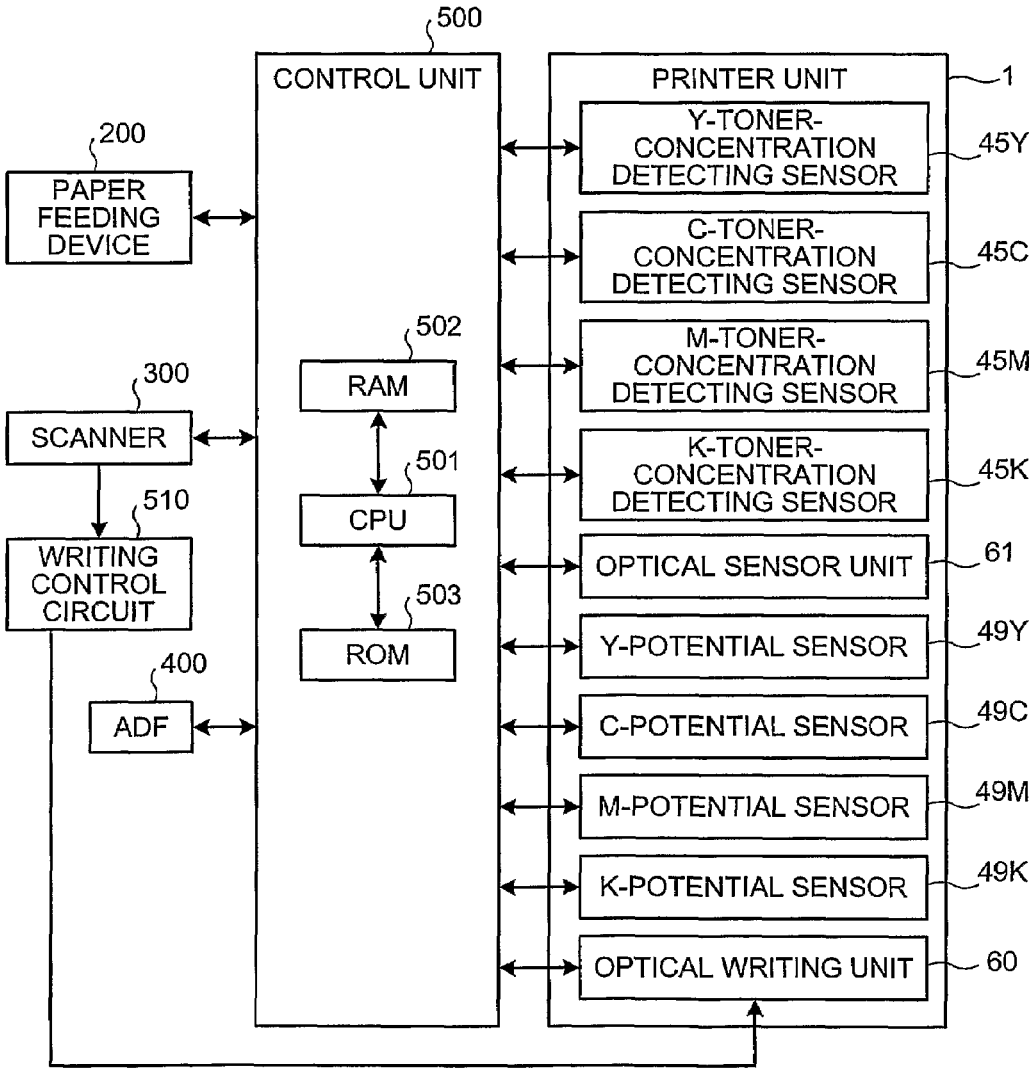
FIG. 5 is a block diagram of the copying machine shown in FIG. 1.

FIG. 5 is a block diagram of a portion of an electric circuit of the copying machine according to the present embodiment. As shown in the drawing, the copying machine includes a control unit 500 that controls each device. The control unit 500 includes a CPU (Central Processing Unit) 501, a ROM (Read Only Memory) 503, and a RAM (Random Access Memory) 502. The CPU 501 executes a calculation or a drive control of each unit. The ROM 503 stores therein fixed data such as a computer program in advance. The RAM 502 serves as a working area in which each data is rewritably stored. The ROM 503 and the RAM 502 are connected to the CPU 501 via a bus. The ROM 503 stores therein a concentration-conversion data table showing a relation between an output voltage from each of the image-density detecting sensor 63Y, 63C, 63M, and 63K (see FIG. 4) in above-mentioned the optical sensor unit 61 and an image density corresponding to the output voltage.

The printer unit 1, the paper feeding device 200, the scanner 300, and the ADF 400 are connected to the control unit 500. In the drawing, although only the sensors and the optical writing unit 60 are indicated as devices included in the printer unit 1 for the sake of convenience, other devices (for example, the transfer unit and the process units) are also controlled to be driven by the control unit 500. An output signal from each of the sensors in the printer unit 1 is transmitted to the control unit 500.

FIG. 6 is a flowchart for explaining a control flow of a parameter correcting process performed by the control unit 500. The parameter correcting process is performed at a predetermined timing, for example, when the copying machine is activated, or on the predetermined number of copies basis (in a case of continuous printing, at each interval between printing processes), or at predetermined time intervals. In a case shown in FIG. 6, there is indicated a processing flow of the parameter correcting process performed when the copying machine is started up. When the parameter correcting process is started, at first, for distinguishing a timing when the copying machine is powered on from that is when an error occurs, a surface temperature of the heating roller in the fixing device 80 (hereinafter, referred to as a "fixing temperature") is detected as a condition for executing the processing flow. It is determined whether the fixing temperature exceeds 100 [° C.]. If the fixing temperature exceeds 100 [° C.] (NO at step S1), it is determined that the copying machine is not powered on, so that the processing flow is terminated.

If the fixing temperature does not exceed 100 [° C.] (YES at step S1), a potential sensor checking is performed (step S2). In the potential sensor checking, each surface potential of the photoreceptors 11Y, 11C, 11M, and 11K that are uniformly charged under a predetermined condition is detected by each of potential sensors 49Y, 49C, 49M, and 49K. Then, a Vsg adjustment for the optical sensor unit 61 is performed (step S3). In the Vsg adjustment, as for each of the sensors (62R, 62C, 62F, 63Y, 63C, 63M, and 63K), a light-emitting amount from a light-emitting element is adjusted so that an output voltage (Vsg) from the light-emitting element, which detects a reflecting light to a non-image area of the intermediate transfer belt 51, can be kept constant. At steps S2 and S3, the potential checking and the Vsg adjustment are performed in parallel with those in each color.

Upon termination of the Vsg adjustment, it is determined whether any error occurs at steps S2 and S3, i.e., during the potential sensor checking and the Vsg adjustment (step S4). If an error occurs (YES at step S4), an error code corresponding to the error is set (step S18), and then the processing flow is terminated. If no error occurs (NO at step S4), it is determined whether an automatic parameter-correcting method is set (step S5). Incidentally, the processes at steps S3 and S4 are executed regardless of the parameter-correcting method.

If the automatic parameter-correcting method is not set up (i.e., a parameter is set up at a fixed value) (NO at step S5), an error code is set, and then the processing flow is terminated. On the other hand, if the automatic parameter-correcting method is set up (YES at step S5), processes at steps S6 to S16, which are explained below, are executed.

At step S6, seven sets of toner patch patterns composed of a plurality of reference toner images as shown in FIG. 4 are formed on the front surface of the intermediate transfer belt 51. These toner patch patterns are formed and aligned in the width direction of the intermediate transfer belt 51 so as to be detected by any of the seven sensors (62R, 62C, 62F, 63Y, 63C, 63M, and 63K) those included in the optical sensor unit 61. Types of the seven sets of the toner patch patterns are divided broadly into two types; one for detecting a concentration tone and the other for detecting a displacement.

Figure 7:
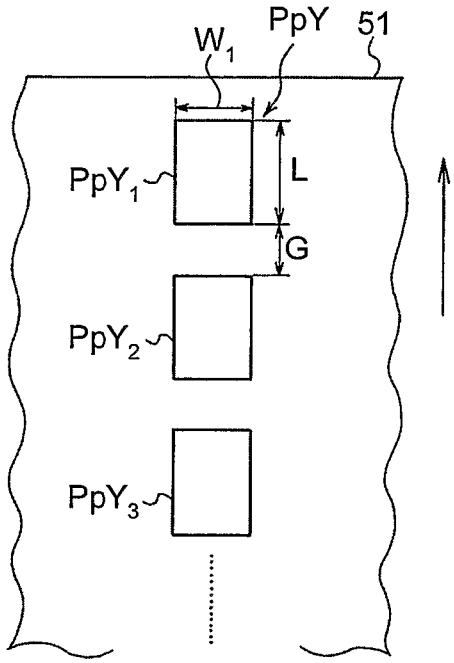
FIG. 7 is an enlarged plane view of a patch pattern for detecting a Y-concentration tone and the intermediate transfer belt.

The patch pattern for detecting a concentration tone is composed of a plurality of concolorous reference toner images (reference toner images for each of Y, C, M, and K colors) having a different image density from one another. The patch patterns for detecting a concentration tone for of Y, C, M, and K colors (PpY, PpC, PpM, and PpK) are individually formed, and detected by the image-density detecting sensors 63Y, 63C, 63M, and 63K respectively. To take the patch pattern PpY for detecting a Y-concentration tone as an example, the patch pattern PpY includes, as shown in FIG. 7, a first reference Y-toner image PpY1, a second reference Y-toner image PpY2, . . . , and an n-th reference Y-toner image PpYn, those aligned in a moving direction of the belt (in a direction of an arrow indicated in the drawing) by keeping a predetermined distance G with one another. Although an image density of the reference Y-toner images is different from one another, a shape and a posture of each reference Y-toner image on the intermediate transfer belt 51 is identical to one another. The reference Y-toner image has a rectangular shape which width direction is along the width direction of the belt and also which longitudinal direction is along with the moving direction of the belt. The rectangular-shaped reference Y-toner image has 15 [mm] of a width W1 and 20 [mm] of a length Ll. The distance G between the reference Y-toner images is 10 [mm]. A distance between the patch patterns those having a different color with one another in the width direction of the belt is 5 [mm].

Each of the reference toner images in the patch patterns for detecting the concentration tone (PpY, PpC, PpM, and PpK) is formed in such a manner that toner images formed on each of the photoreceptors (11Y, 11C, 11M, and 11K) in the process units (10Y, 10C, 10M, and 10K) are transferred onto the intermediate transfer belt 51. When each of the reference toner images is passed just beneath the image-density detecting sensors (63Y, 63C, 63M, and 63K) respectively in accordance with the endless movement of the intermediate transfer belt 51, a light emitted from the sensor is reflected by a surface of each of the reference toner images. An amount of the reflected light is correlated with an image density of each of the reference toner images. The control unit 500 stores an output voltage from the sensor as for each reference toner image, as Vpi (i=1 to N), in the RAM 502 by each color (step S8). Based on the output voltage from the sensor and the concentration-conversion data table stored in the ROM 503 in advance, an image density of each reference toner image (an amount of adhered toner per unit area) is determined, and a result of the determination is stored in the RAM 502 (step S9). Before each patch pattern for detecting the concentration tone is developed on each photoreceptor, a potential of each reference latent image as a precursor of the reference toner image is detected by the potential sensor, and a result of the detection is sequentially stored in the RAM 502 (step S7).

Figure 8:
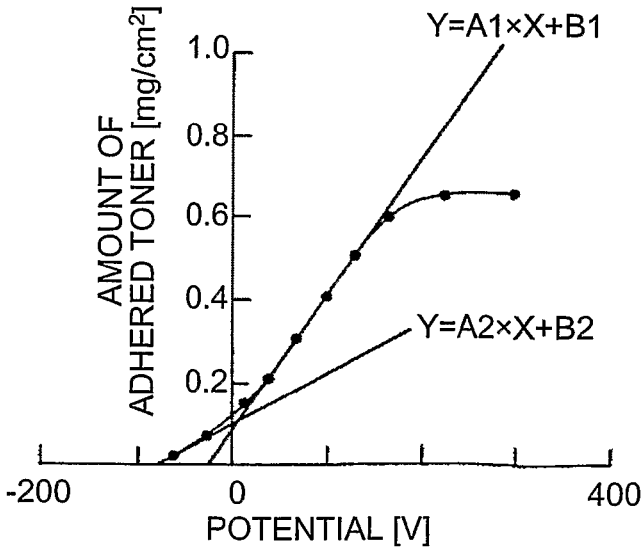
FIG. 8 is a graph showing a relation between amount of adhered toner and potential.

After the amount of adhered toner with respect to each reference toner image is determined, an appropriate developing potential of each developing device is obtained (step S10). Specifically, for example, a relation between the potential of each reference latent image obtained at step S7 and the amount of adhered toner obtained at step S9 is plotted on an X-Y plane as shown in FIG. 8. In the drawing, an X-axis indicates the potential (a difference between a developing bias VB and a potential of each latent image), and a Y-axis indicates the amount of adhered toner per unit area [mg/cm$^2$]. As described above, the reflective photosensor is used as each of the sensors in the optical sensor unit 61. As shown in FIG. 8, the output voltage from the sensor is saturated if the amount of adhered toner excessively increases with respect to the reference toner image. Therefore, if the amount of adhered toner is calculated based on the sensor-output voltage of the reference toner image having a relatively large amount of adhered toner directly, it causes an error. Consequently, as shown in a graph in FIG. 9, out of a plurality of combinations of data composed of the potential of the reference latent image and the amount of adhered toner with respect to the reference toner image, combinations of data corresponding to a portion of a straight line indicated in the graph of the relation between the potential of the reference latent image and the amount of adhered toner are selected. Then, the least square method is applied to the data corresponding to the portion, and thereby obtaining a straight-line approximation of developing characteristics. Then, a developing potential by each color is obtained based on an Equation (E) of the straight-line approximation, which is obtained by each color. In the copying machine according to present embodiment, a specular reflection type of the reflective photosensor is used, but not limited to. Alternatively, a diffuse reflection type of the reflective photosensor can be used.

For the calculation by the least square method, following Equations are used.

$$Xave=\Sigma Xn/k \quad (1)$$

$$Yave=\Sigma Yn/k \quad (2)$$

$$Sx=\Sigma(Xn-Xave)\times(Xn-Xave) \quad (3)$$

$$Sy=\Sigma(Yn-Yave)\times(Yn-Yave) \quad (4)$$

$$Sxy=\Sigma(Xn-Xave)\times(Yn-Yave) \quad (5)$$

When it is assumed that the Equation (E) of the straight-line approximation, which is obtained based on the output value from each potential sensor for each color (the potential of each reference latent image for each color) and the amount of adhered toner (the image density) with respect to each reference toner image for each color, is Y=A1×X+B1, the coefficients A1 and B1 can be indicated as follows.

$$A1=Sxy/Sx \quad (6)$$

$$B1=Yave-A1\times Xave \quad (7)$$

Furthermore, a correlation coefficient R of the Equation (E) of the straight-line approximation can be indicated as follows.

$$R\times R=(Sxy\times Sxy)/(Sx\times Sy) \quad (8)$$

Every five potential data Xn, which is obtained in the processes till at step S9 based on the potential of each reference latent image by each color and the amount of adhered toner, and every five data Yn on the amount of adhered toner after imaging by each color in the processes till at step S9, those selected in numeric order, are paired as follows.

(X1-X5, Y1-Y5)
(X2-X6, Y2-Y6)
(X3-X7, Y3-Y7)
(X4-X8, Y4-Y8)
(X5-X9, Y5-Y9)
(X6-X10, Y6-Y10)

Then, the straight-line approximation is calculated in accordance with the above Equations (1) to (8), and also the correlation coefficient R is calculated. As a result, following six pairs of an Equation of the straight-line approximation and a correlation coefficient (9) to (14) are obtained.

$$Y11=A11\times X+B11;\ R11 \quad (9)$$

$$Y12=A12\times X+B12;\ R12 \quad (10)$$

$$Y13=A13\times X+B13;\ R13 \quad (11)$$

$$Y14=A14\times X+B14;\ R14 \quad (12)$$

$$Y15=A15X+B15;\ R15 \quad (13)$$

$$Y16=A16\times X+B16;\ R16 \quad (14)$$

Out of the obtained six pairs, any one of the Equations of the straight-line approximation that is paired with the maximum correlation coefficient among the correlation coefficients R11 to R16 is selected as the Equation (E) of the straight-line approximation.

With the Equation (E) of the straight-line approximation, as shown in FIG. 9, an amount of X when an amount of Y indicates a necessity maximum amount of adhered toner Mmax, i.e., an amount of a developing potential Vmax is calculated. Each developing bias potential VB of each developing device for each color and an appropriate latent-image potential (a potential of an exposed portion) VL corresponding to the developing bias potential VB are obtained by following Equations (15) and (16).

$$Vmax=(Mmax-B1)/A1 \quad (15)$$

$$VB-VL=Vmax=(Mmax-B1)/A1 \quad (16)$$

A relation between VB and VL can be expressed by a coefficient of the Equation (E) of the straight-line approximation. Therefore, the Equation (16) can be expressed as follows.

$$Mmax=A1\times Vmax+B1 \quad (17)$$

A relation between a background-portion potential VD, which is a potential of the photoreceptor before being exposed, and the developing bias potential VB is obtained by an X-coordinate VK (a voltage when the developing device starts developing), which is an intersection of an Equation of a straight line, as shown in FIG. 9, i.e., $$Y=A2*X+B2 \quad (18)$$

with an X-axis, and an experimentally-obtained scumming surplus voltage Vα with using a following Equation.

$$VD-VB=VK+V\alpha \quad (19)$$

Therefore, a relation among Vmax, VD, VB, and VL is defined by the Equations (16) and (19). In this case in which Vmax is referred to as a reference value, a relation between Vmax and each voltage (VD, VB, and VL) was obtained by an experiment or the like in advance, and expressed by a table as shown in FIG. 10. The table is stored in the ROM 503 as a potential control table.

Then, most approximate Vmax to the Vmax calculated by each color is selected from the potential control table, and each of control voltages (potentials) VB, VD, and VL those corresponding to the selected Vmax is defined as a target potential (step S11).

After that, a laser emission power of a semiconductor laser of the optical writing unit 60 is controlled to be the maximum light intensity via a writing control circuit 510 by each color, and an output value from the potential sensor is acquired, and thereby detecting a residual potential of the photoreceptor (step S12). When the residual potential is not zero, the target potentials VB, VD, and VL, which are defined at step S11, are respectively compensated by a potential corresponding to the residual potential so as to be defined as the target potential.

Then, it is determined whether any error occurs at steps S5 to S13 (step S14). If an error occurs even in one single color (YES at step S14), even when those for other colors are controlled, a fluctuation in an image density increases, and thus subsequent processes end up in vain. Therefore, an error code (step S18), and then a series of the processing flow is terminated. In this case, conditions for forming the image are not updated, and an image is to be formed under the same conditions as that is for the last time until the next parameter correcting process is performed successfully.

If it is determined that no error occurs (NO at step S14), a power supply circuit (not shown) is adjusted so that each background-portion potential VD of each photoreceptor can get to the target potential in parallel with one another in each color. Then, the laser emission power of the semiconductor laser is adjusted via a laser control unit (not shown) so that the surface potential of the photoreceptor VL can get to the target potential. Also, in each developing device, the power supply circuit is adjusted so that each developing bias potential VB can get to the target potential (step S15).

Then, it is determined whether any error occurs at step S15 (step S16). If no error occurs (NO at step S16), after a displacement correcting process, which is explained later, is performed, the series of the processing flow is terminated. On the other hand, if an error occurs (YES at step S16), an error code is set, and then the series of the processing flow is terminated.

The patch pattern for detecting a displacement, as shown in FIG. 4, includes three patch patterns, i.e., a patch pattern PcR for detecting a displacement in the rear side, which is formed near one end of the intermediate transfer belt 51 in the width direction, a patch pattern PcC for detecting a displacement in the center, which is formed in the center of the intermediate transfer belt 51 in the width direction, and a patch pattern PcF for detecting a displacement in the front side, which is formed near the other end of the intermediate transfer belt 51 in the width direction. Each of the patch patterns for detecting a displacement includes a plurality of reference toner images aligned in the belt-moving direction. The reference toner images, which are included in each of the three patch patterns for detecting a displacement, include reference toner images for Y, C, M, and K colors. If no displacement occurs in each photoreceptor or each exposure optical system in all of the rear side, in the center, and in the front side, the reference toner images by each color are formed by keeping the same space and the same posture with one another. However, if any displacement occurs, the spaces between the formed reference toner images are not constant, or the posture of the reference toner image is tilted. Therefore, in the displacement correcting process (step S17), a deviation of the spaces between the formed reference toner images or a deviation of the posture is detected based on a detecting time interval of each reference toner image. Then, based on a result of the detection, a mirror tilt of the exposure optical system is adjusted by a tilt correcting mechanism (not shown), or an exposure start timing is corrected. As a result, the displacement of each toner image by each color can be reduced.

Figure 12:
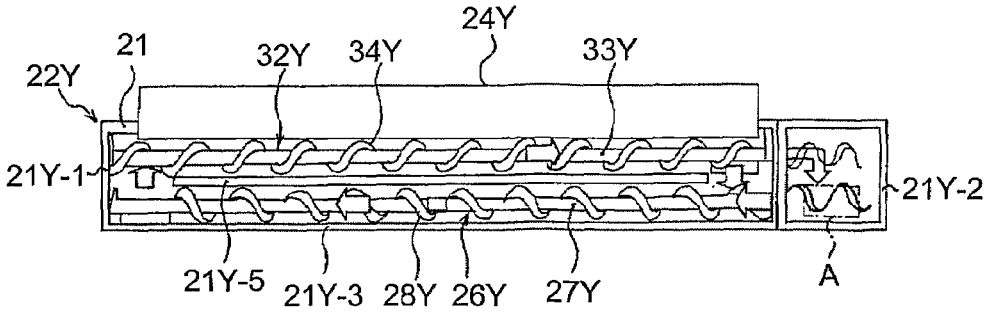
FIG. 12 is an exploded plane view of the Y-color developing device shown in FIG. 11 viewed from above.

FIG. 11 is an exploded perspective view of the developing device 20Y. FIG. 12 is an exploded plane view of the developing device 20Y viewed from above. As described above, the developing device 20Y includes the developing unit 23Y containing the developing sleeve 24Y and the developer conveying device 22Y that conveys the Y-developer by agitating the Y-developer. The developer conveying device 22Y includes the first conveyance chamber containing the first screw member 26Y as the agitation conveying member and the second conveyance chamber containing the second screw member 32Y as the agitation conveying member. The first screw member 26Y includes a rotating shaft member 27Y which both ends in an axis direction are rotatably supported by the bearings respectively and a spiral blade 28Y provided in a spirally-protruding manner on a perimeter surface of the rotating shaft member 27Y. The second screw member 32Y also includes a rotating shaft member 33Y which both ends in the axis direction are rotatably supported by the bearings respectively and a spiral blade 34Y provided in the spirally-protruding manner on a perimeter surface of the rotating shaft member 33Y.

The first screw member 26Y in the first conveyance chamber as the developer conveying unit is surrounded by walls of the casing. Both sides of the first screw member 26Y in the axis direction are surrounded by a rear-side plate 21Y-1 and a front-side plate 21Y-2 of the casing. Out of the other both sides of the first screw member 26Y in a direction perpendicular to the axis direction, in the one of the sides, a left-side plate 21Y-3 of the casing as a side wall is extended in a rotation axis direction of the first screw member 26Y by keeping a predetermined distance from the first screw member 26Y. In the other side, a partition wall 21Y-5 as a side wall dividing into the first and second conveyance chambers is extended in the rotation axis direction of the first screw member 26Y by keeping a predetermined distance from the first screw member 26Y.

The second screw member 32Y in the second conveyance chamber as the developer conveying unit is also surrounded by walls of the casing. Both sides of the second screw member 32Y in the axis direction are surrounded by the rear-side plate 21Y-1 and the front-side plate 21Y-2 of the casing. Out of the other both sides of the second screw member 32Y in the direction perpendicular to the axis direction, in the one of the sides, a right-side plate 21Y-4 of the casing as a side wall is extended in the rotation axis direction of the second screw member 32Y by keeping a predetermined distance from the second screw member 32Y. In the other side, the partition wall 21Y-5 dividing into the first and second conveyance chambers is extended in the rotation axis direction of the second screw member 32Y by keeping a predetermined distance from the second screw member 32Y.

The second screw member 32Y surrounded by the walls conveys a Y-developer (not shown) held inside the spiral blade 34Y from the left side to the right side in FIG. 12 along the rotation axis direction by agitating the Y-developer in a rotating direction as the second screw member 32Y is driven to rotate. The second screw member 32Y and the developing sleeve 24Y are arranged in parallel with each other, so that a conveying direction of the Y-developer is also a direction along a rotation axis direction of the developing sleeve 24Y. The second screw member 32Y supplies the Y-developer in its axis direction with respect to the surface of the developing sleeve 24Y.

The Y-developer conveyed near the right-end side of the second screw member 32Y in the drawing enters into the first conveyance chamber through an opening provided on the partition wall 21Y-5, and then held inside the spiral blade 28Y of the first screw member 26Y. Then, the Y-developer is conveyed from the right side to the left side in the drawing along the rotation axis direction of the first screw member 26Y by being agitated in a rotating direction as the first screw member 26Y is driven to rotate.

In the first conveyance chamber, the Y-toner-concentration detecting sensor 45Y is fixed on a bottom wall of the casing that is a portion of an area in which the first screw member 26Y is surrounded by the left-side plate 21Y-3 of the casing and the partition wall 21Y-5. The Y-toner-concentration detecting sensor 45Y detects a permeability of the Y-developer conveyed along the rotation axis direction by the first screw member 26Y from downwards, and outputs a voltage corresponding to a result of the detection to the control unit 500. The permeability of the Y-developer is correlated with a Y-toner concentration of the Y-developer, so that it can be said that the control unit 500 grasps the Y-toner concentration based on the output voltage from the Y-toner-concentration detecting sensor 45Y.

In the printer unit 1, Y, C, M, and K-toner refilling units (not shown) for separately refilling Y, C, M, and K toners are respectively provided in the Y, C, M, and K developing devices. The control unit 500 stores Vtref by each of Y, C, M, and K colors, that are target values of output voltages from the Y, C, M, and K-toner-concentration detecting sensors 45Y, 45C, 45M, and 45K, in the RAM 502. If a difference between each output voltage from the Y, C, M, and K-toner-concentration detecting sensors 45Y, 45C, 45M, and 45K and each target value Vtref for each of Y, C, M, and K colors exceeds a threshold, any of the Y, C, M, and K-toner refilling units are driven only for a time corresponding to the difference. Consequently, any of the Y, C, M, and K toners is refilled from a toner refilling opening (for example, as indicated by "A" in FIG. 12) provided in the uppermost stream side of the first conveyance chamber in each of the Y, C, M, and K developing devices into the first conveyance chamber, so that the Y, C, M, and K-toner concentrations in the Y, C, M, and K-developers are maintained within a certain definite range.

The permeability of the developer is well correlated with a bulk density of the developer. The bulk density of the developer fluctuates depending on a condition of leaving the developer even if the toner concentration of the developer is kept constant. For example, the developer that is left without being agitated by the screw member for a long time in the first conveyance chamber or the second conveyance chamber lets out air between toner particles or carriers by its own weight, and also causes a degradation of the charge amount of the toner particles, so that the bulk density is gradually increased as the developer-leaving time advances. Then, with the increase of the bulk density, the permeability gradually increases. When the developer is left for the relatively long time, the increases of the bulk density and the permeability are saturated. In such the saturated condition, a distance between the magnetic carriers is shortened as compared with that is of the developer during an execution of forming the image (or being agitated). Therefore, it is erroneously detected that the toner concentration is degraded from the original amount.

Figure 13:
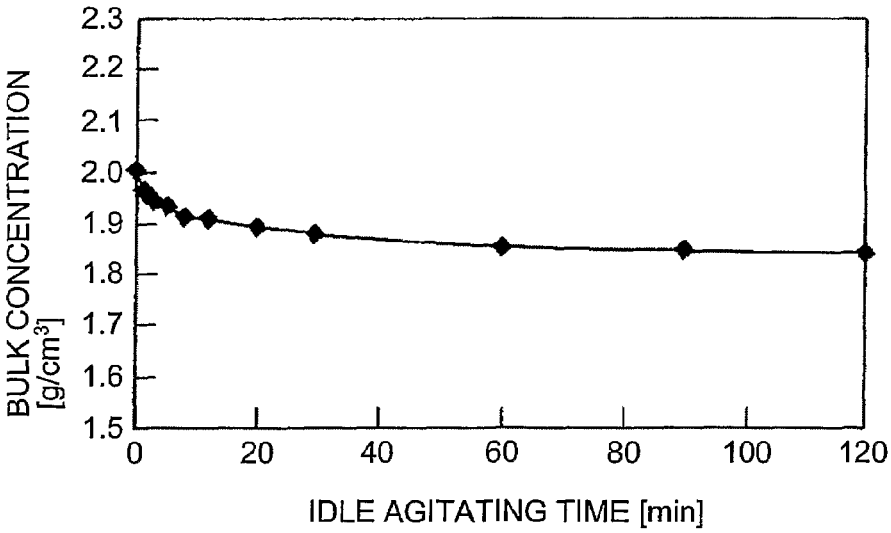
FIG. 13 is a graph showing a relation between bulk density and idle agitating time of a developer.
Figure 14:
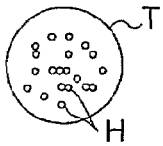
FIG. 14 is an enlarged schematic diagram of toner particles in a default state.
Figure 15:
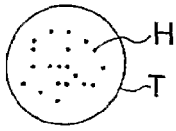
FIG. 15 is an enlarged schematic diagram of the toner particles in the developer that is idle agitated for 30 minutes.

On the other hand, when the developer in which the increases of the bulk density and the permeability are saturated because the developer is left for the long time is agitated by the screw member in the first conveyance chamber or the second conveyance chamber, air is let in between the toner particles or the magnetic carriers, and also a frictional charge amount of the toner particles increases. Therefore, after the developer is left for the long time in the first conveyance chamber or the second conveyance chamber, when the screw member is rotated even though the developing process is not performed, i.e., the screw member starts idle agitating, as shown in FIG. 13, the bulk density is promptly degraded for approximately three minutes just from an idle-agitation start time. This is because the air is let in the developer, and the frictional charge amount of the toner particles promptly increases. After that, although a degradation rate of the bulk density is reduced, the bulk density is slowly degraded as the idle-agitating time advances. This is because the frictional charge amount of the toner particles gradually increases due to a friction of additives added to the toner particles. Specifically, as shown in FIG. 14, additives H for increasing a toner powder flowability are added to a toner particle T. As the additives H are gradually abraded away due to the idle agitation of the developer, a frictional force between the toner particles T gradually increases. While approximately three minutes passes just from the idle-agitation start time, the increase of the frictional charge amount of the toner particles reaches almost saturation. After that, as the frictional force between the toner particles T gradually increases due to the friction of the additives H, the frictional charge amount of the toner particles T slowly increases along with the increase of the frictional force. Consequently, even after the lapse of three or more minutes from the idle-agitation start time, the bulk density of the developer is slowly degraded as time advances. FIG. 14 depicts the toner particle T in a default state. After the elapse of 30 minutes from the idle-agitation start time, the state of the toner particles T is changed to that is shown in FIG. 15. Incidentally, the flowability and the bulk density can be measured by the "metallic powders-determination of apparent density-funnel method" described in JIS Z 2504:2000.

Figure 16:
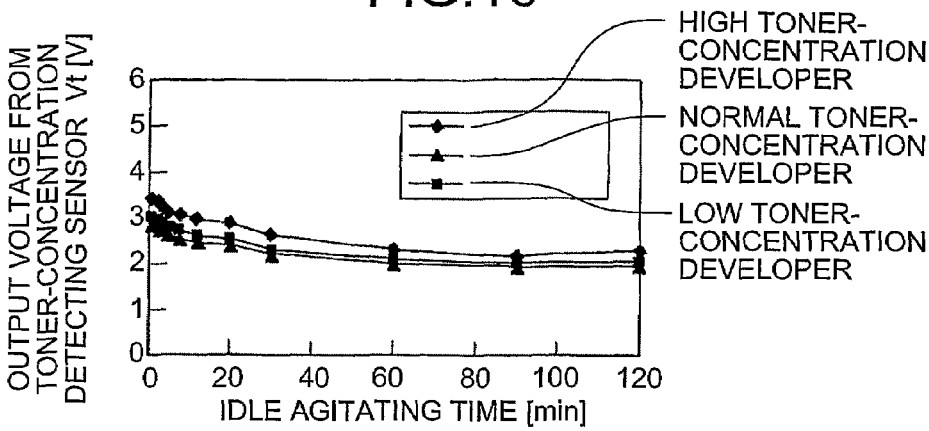
FIG. 16 is a graph showing a relation between output voltage [volt] from a toner-concentration detecting sensor and the idle agitating time [minute]
Figure 17:
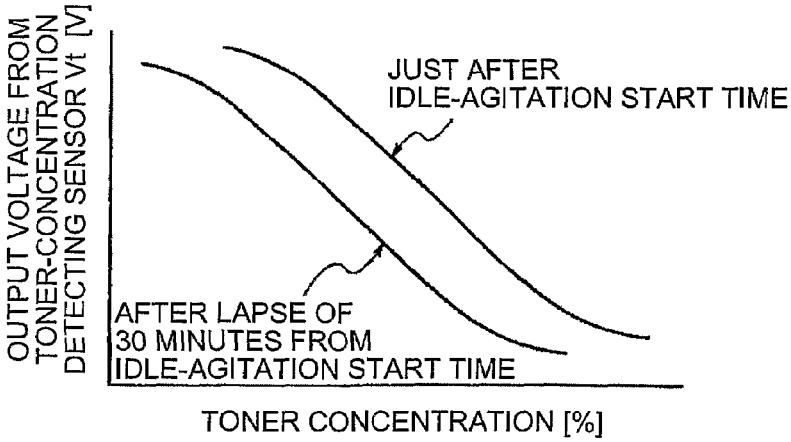
FIG. 17 is a graph showing a relation between the output voltage from the toner-concentration detecting sensor and a toner concentration.

In this manner, as the time of the idle agitation advances, the bulk density of the developer is slowly degraded for the long time. Then, as shown in FIG. 16, the permeability of the developer (an output voltage from the toner-concentration detecting sensor) is gradually degraded, and a result of the detection of the toner concentration gradually decreases. Even though the toner concentration of the developer at right after the idle-agitation start time and that is after the elapse of 30 minutes from the start time are constant, a significant difference occurs in the output voltage from the toner-concentration detecting sensor, as shown in FIG. 17. Consequently, an erroneous detection of the toner concentration is caused.

In the developing device disclosed in Japanese Patent Application Laid-Open No. 6-308833, to prevent an occurrence of such the erroneous detection, out of a whole area of the developer conveying unit, a pressure of the developer in an area where the toner-concentration detecting sensor detects the toner concentration is increased as compared with that is in other area. However, the pressure indicates a pressure in the conveying direction of the developer (in the rotation axis direction of the screw member). According to the experiment performed by the present inventors, the pressure was not correlated well with a rate of the occurrence of the erroneous detection.

Figure 18:
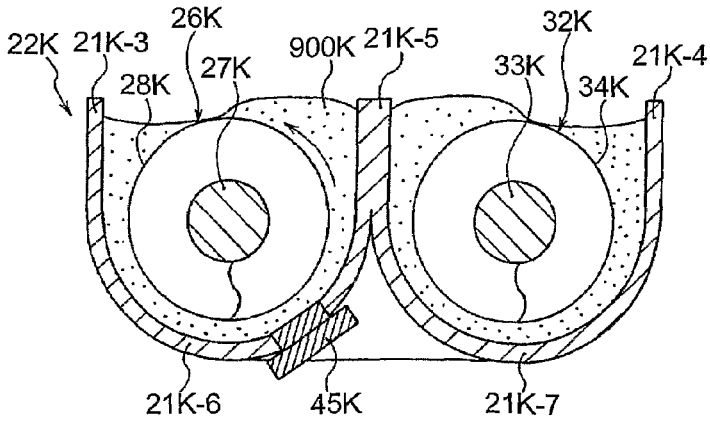
FIG. 18 is an enlarged schematic diagram of a K-developer conveying device of a K-color developing device in the printer unit.

A reason why the pressure is not correlated well with a frequency of the occurrence of the erroneous detection is explained below. FIG. 18 is an enlarged schematic diagram of a developer conveying device 22K of the K developing device. In the drawing, a bottom wall 21K-6 of the first conveyance chamber containing a first screw member 26K faces to the downside of the first screw member 26K in a direction of a gravitational force by keeping a predetermined space. Also, a left-side plate 21K-3 of the first conveyance chamber faces to one of the lateral sides perpendicular to a rotation axis direction of the first screw member 26K by keeping a predetermined space. A partition wall 21K-5 of the first conveyance chamber faces to the other lateral side by keeping a predetermined space. A K-developer 900K is held not only inside a spiral blade 28K of the first screw member 26K, but also a clearance between outside the spiral blade 28K and the left-side plate 21K-3, a clearance between outside the spiral blade 28K and the bottom wall 21K-6, and a clearance between outside the spiral blade 28K and the partition wall 21K-5. The K-toner-concentration detecting sensor 45K fixed on a casing of the developing device cannot detect a K-toner concentration of the K-developer held inside the spiral blade 28K located relatively far from the K-toner-concentration detecting sensor 45K because a detectable distance range of the K-toner-concentration detecting sensor 45K is relatively small. The K-toner-concentration detecting sensor 45K can detect the K-toner concentration of the K-developer 900K held in the clearance between outside the spiral blade 28K and the bottom wall 21K-6. Therefore, the K-developer 900K held in the clearance needs to be pressurized sufficiently; however, pressure generated in accordance with a rotation of the first screw member 26K mainly acts on the K-developer 900K held inside the spiral blade 28K in a conveying direction of the K-developer 900K (in the rotation axis direction). Even when the K-developer 900K held inside the spiral blade 28K is sufficiently pressurized in the conveying direction, the K-developer 900K held in the clearance may not be pressurized sufficiently. This is the reason why the pressure applied to the developer in the conveying direction is not correlated well with the rate of the occurrence of the erroneous detection.

Furthermore, the present inventors found that, in the configuration shown in the drawing, there is a problem as follows. Namely, the K-developer 900K near the K-toner-concentration detecting sensor 45K could not be shuffled actively unless the K-developer 900K is pressed on a surface of the K-toner-concentration detecting sensor 45K by sufficient pressure in accordance with the rotation of the first screw member 26K. Even though the first screw member 26K rotated many times, the same K-developer 900K stagnated near the K-toner-concentration detecting sensor 45K for a long time. Therefore, the K-toner-concentration detecting sensor 45K kept detecting the toner concentration of the same K-developer 900K. Consequently, a change of the actual K-toner concentration of the K-developer 900K cannot be detected promptly.

Therefore, the developer needs to be pressed firmly on a permeability-detecting surface of the toner-concentration detecting sensor by increasing not the pressure applied to the developer in the axis direction of the screw (the conveying direction) but the pressure in a rotating direction of the screw. In the case shown in FIG. 18, the permeability-detecting surface of the K-toner-concentration detecting sensor 45K is configured to have contact with the K-developer 900K inside the first conveyance chamber. It is also possible to employ a configuration shown in FIG. 19. In the case shown in FIG. 19, a wall of the first conveyance chamber (in this case, the bottom wall 21K-6 in the drawing) is provided between the K-developer 900K inside the first conveyance chamber and the K-toner-concentration detecting sensor 45K. In this case, the K-developer 900K needs to be pressed firmly on the wall provided between the K-developer 900K and the K-toner-concentration detecting sensor 45K by the application of a rotating force of the first screw member 26K.

Figure 19:
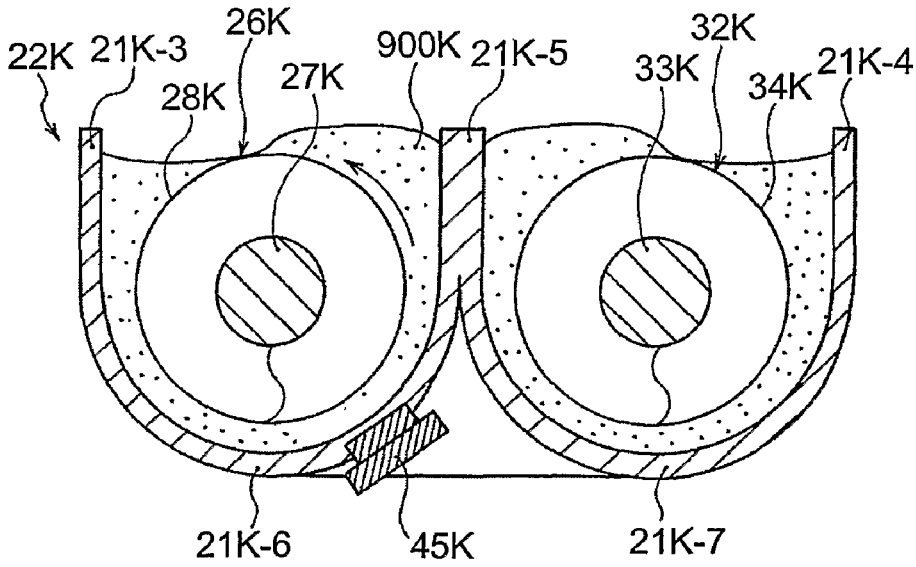
FIG. 19 is an enlarged schematic diagram of the K-developer conveying device in which a wall is provided between a K-toner-concentration detecting sensor and a K-developer in a first conveyance chamber.
Figure 20:
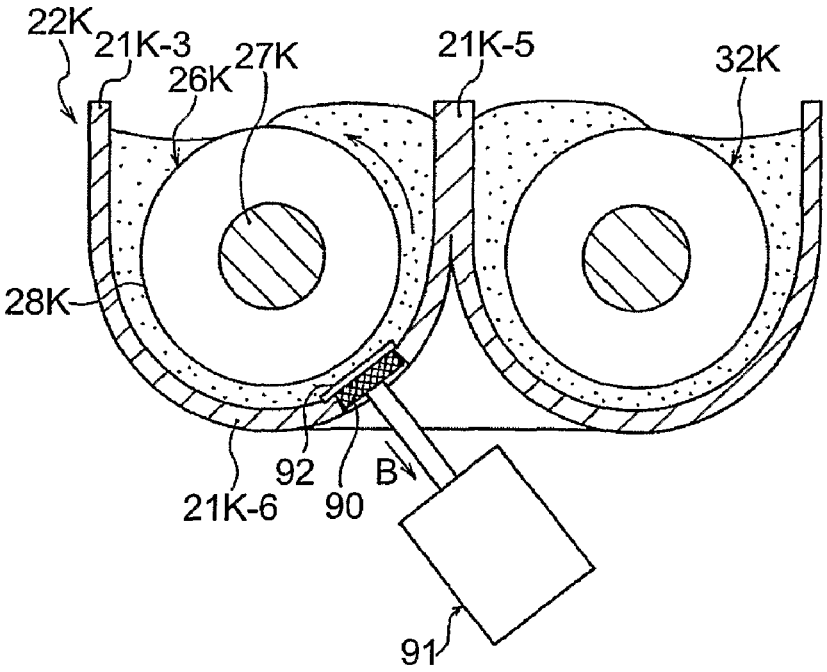
FIG. 20 is an enlarged schematic diagram of the K-developer conveying device included in a test device.

Consequently, the present inventors carried out an experiment in such a manner that a result of the detection by the K-toner-concentration detecting sensor 45K was checked by changing a pressing force on the K-developer 900K inside the first conveyance chamber with respect to the K-toner-concentration detecting sensor 45K. Specifically, at first, a test device having the same configuration as that is of the copying machine shown in FIG. 1 was prepared. The test device was configured in the same manner as that is shown in FIG. 19, i.e., the bottom wall 21K-6 of the first conveyance chamber was provided between the K-developer 900K inside the first conveyance chamber and the K-toner-concentration detecting sensor 45K, so that it was necessary to measure the pressing force on the K-developer 900K with respect to the bottom wall 21K-6. Therefore, the developer conveying device 22K of the developing device for K color was modified to as shown in FIG. 20. A hole was made on a portion of the bottom wall 21K-6 of the first conveyance chamber, which is located between the K-developer 900K and the K-toner-concentration detecting sensor 45K. A dimension of the hole was approximately the same size as 50[%] of a plane dimension of a detection coil contained in a permeability detecting unit of the K-toner-concentration detecting sensor 45K (6 mm in diameter). A circular load receiving plate 90 having a dimension that is slightly smaller than that is of the hole (5.3 mm in diameter) was prepared, and attached to an ultrasmall-capacity load cell (LTS500GA: rated capacity 5N) 91 manufactured by Kyowa Electronic Instruments Co., Ltd. Then, a dynamic-strain measuring device (DPM-711B: set at L.P.F.=2 kHz) (not shown) was electrically-connected to the ultrasmall-capacity load cell 91 so as to measure the pressure applied to the load receiving plate 90. The load receiving plate 90 attached to the ultrasmall-capacity load cell 91 was inserted into the hole made on the bottom wall 21K-6 of the first conveyance chamber. Then, to measure a load on the load receiving plate 90 accurately, the ultrasmall-capacity load cell 91 was fixed firmly on a supporting unit (not shown) with preventing the load receiving plate 90 from having contact with an inner wall of the hole. Furthermore, to prevent the K-developer 900K from flowing into a minute gap between the load receiving plate 90 and the inner wall of the hole, the entire hole was covered with a flexible film sheet 92 (made of polyvinylidene chloride, polyvinyl chloride, or the like, and having about 10 μm of a thickness) from inside the first conveyance chamber. The film sheet 92 has good adhesion and durability, so that the film sheet 92 is not torn even if the film sheet 92 gets inside the hole by the application of the pressing force on the K-developer 900K. With such the configuration, it is possible to measure the pressing force on the K-developer 900K with respect to the load receiving plate 90 in a direction of an arrow B in the drawing. Instead of the film sheet 92, a thin-layered adhesive compound can be used as long as the thin-layered adhesive compound has enough adhesion and durability required for the measurement (note that the thin-layered adhesive compound needs to avoid adhering to the load receiving plate 90).

Figure 21:
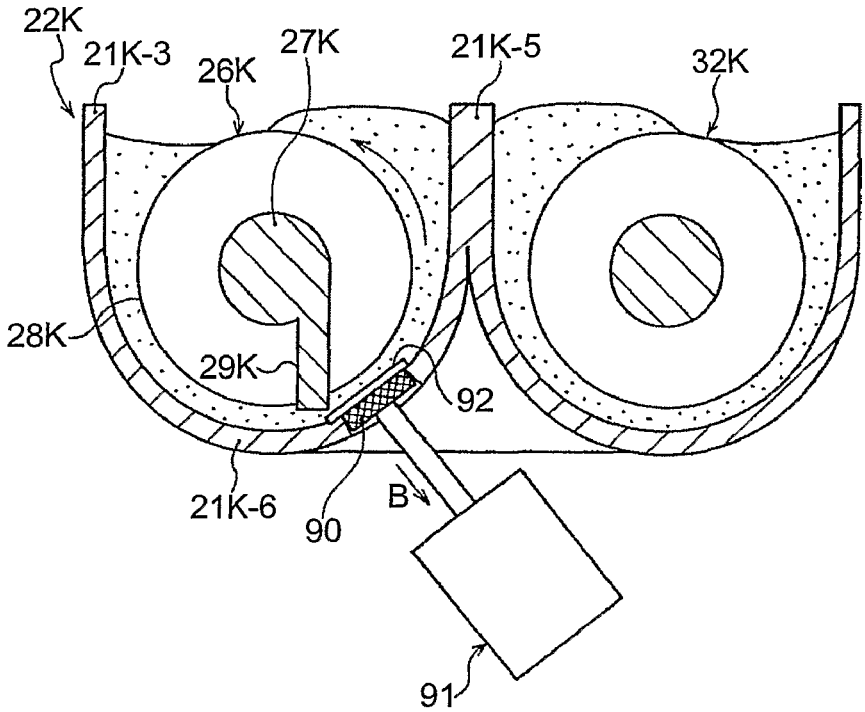
FIG. 21 is an enlarged schematic diagram of the K-developer conveying device in which a first screw member includes a fin member.
Figure 22:
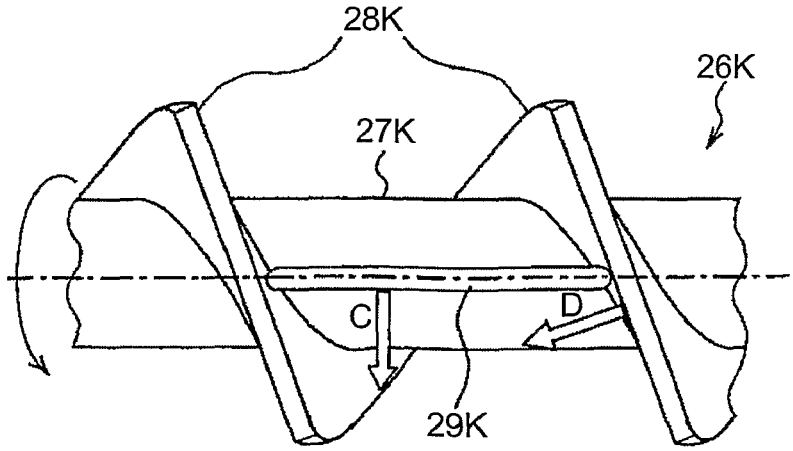
FIG. 22 is an enlarged side elevational view of a portion of the first screw member.

To press the K-developer 900K inside the first conveyance chamber more firmly on the load receiving plate 90, a configuration of the first screw member 26K was changed to that is shown in FIG. 21 as needed. In the first screw member 26K shown in FIG. 21, a fin member 29K was provided on a rotating shaft member 27K in such a manner that the fin member 29K protrudes into an area facing the load receiving plate 90. The fin member 29K was, as shown in FIG. 22, arranged between blade members aligned in an axis direction in the spiral blade 28K, and protruded from the rotating shaft member 27K with extending on a perimeter surface of the rotating shaft member 27K in a rotation axis direction. As shown in FIG. 21, the K-developer 900K held in the spiral blade 28K was moved in a normal direction (in a direction of an arrow C shown in FIG. 22) in accordance with a rotation of the rotating shaft member 27K, so that the K-developer 900K located between outside the spiral blade 28K and the bottom wall 21K-6 could be pressed firmly towards the load receiving plate 90. Incidentally, a direction of an arrow D shown in FIG. 22 indicates a direction of a force applied to the K-developer in accordance with a rotation of the spiral blade 28K.

Figure 23:
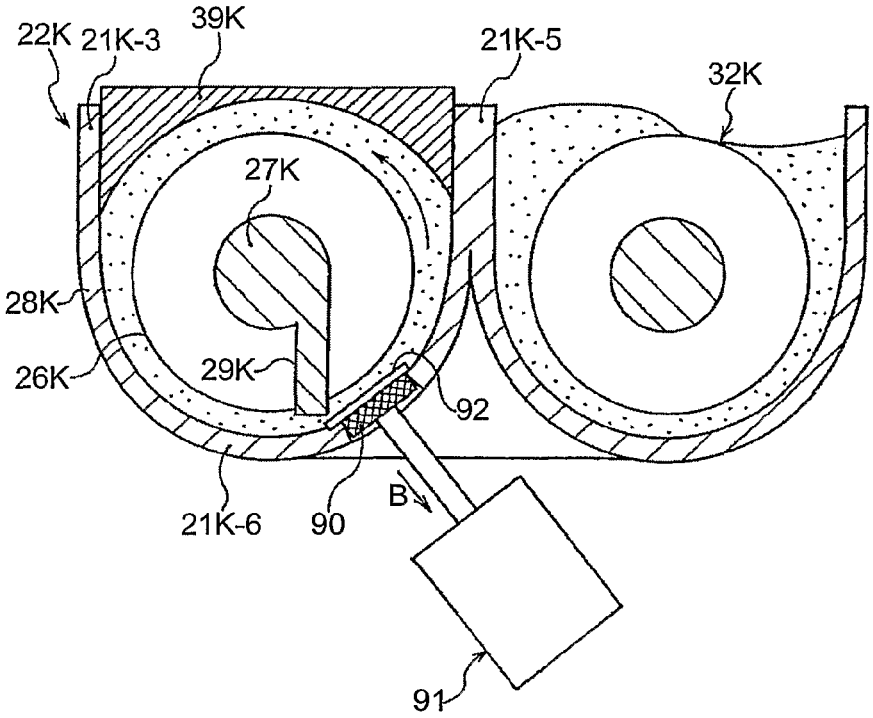
FIG. 23 is an enlarged schematic diagram of the K-developer conveying device in which a dome member is provided.

To press the K-developer 900K inside the first conveyance chamber further more firmly on the load receiving plate 90, a dome member 39K, as shown in FIG. 23, was provided in an area of the first conveyance chamber facing the load receiving plate 90 as needed. The dome member 39K was hung between the left-side plate 21K-3 and the partition wall 21K-5 those included in the first conveyance chamber to cover the first conveyance chamber from above. A curved surface along a curvature of the spiral blade 28K was formed on a surface of the dome member 39K facing the first screw member 26K. Such the configuration of the dome member 39K presses the K-developer 900K downward in a vertical direction by having contact with the K-developer 900K, which moves from downward to upward in a direction of a gravitational force in accordance with a rotation of the fin member 29K, from upward in the vertical direction. Therefore, a pressing force on the K-developer 900K with respect to the load receiving plate 90 could be increased furthermore.

Figure 24:
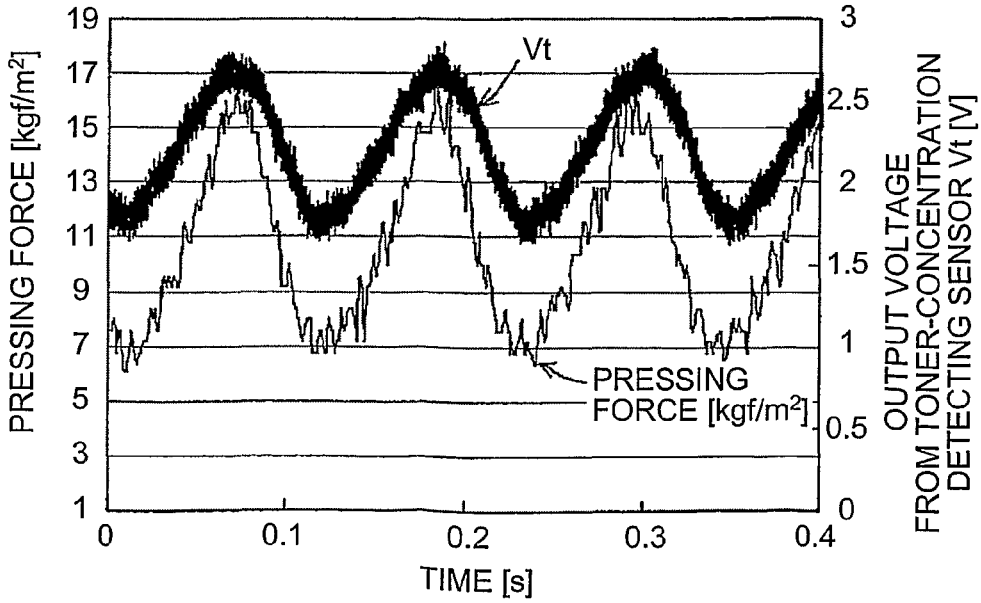
FIG. 24 is a graph showing a relation among a pressing force, a lapse time, and the output voltage from the toner-concentration detecting sensor.

FIG. 24 is a graph showing a relation between the pressing force on the K-developer 900K with respect to the load receiving plate 90, which was detected by the test device of the developer conveying device 22K shown in FIG. 23, and a lapse time. As shown in the drawing, the relation between the pressing force and the lapse time indicates a sine-wave pattern. This is because the pressing force on the K-developer 900K with respect to the load receiving plate 90 is maximized when the fin member 29K of the first screw member 26K passes through the area facing the load receiving plate 90 in accordance with the rotation of the first screw member 26K. If a combination of the load receiving plate 90 and the ultrasmall-capacity load cell 91 is replaced with the K-toner-concentration detecting sensor (45K), as can be seen in the drawing, a relation between the output voltage from the toner-concentration detecting sensor and the lapse time indicates a sine-wave pattern, and a period of the sine-wave pattern is synchronized with that is of the pressing force. Namely, at a timing when the pressing force on the K-developer 900K with respect to the load receiving plate 90 is maximized, the output voltage from the toner-concentration detecting sensor is also maximized, so that the toner concentration can be detected accurately.

In the test device, the control unit (500) is set as follows. Outputs from the K-toner-concentration detecting sensor 45K are sampled in a period of twenty or more times longer (at 4-msec intervals) than a rotation period of the first screw member 26K (one period of the sine-wave pattern shown in FIG. 24), and the sampled data is sequentially stored in the RAM (502). Out of the sampled data by each one period of the first screw member 26K, the sampled data is extracted by 10[%] of the number of the sampled data in the order of the highest value, and then an average of the extracted data is employed as the output voltage from the toner-concentration detecting sensor. Consequently, a sensor output when the K-developer is properly pressed towards a detecting surface of the K-toner-concentration detecting sensor 45K by each period of the first screw member 26K is employed, so that an erroneous detection can be reduced.

Subsequently, the present inventors carried out an experiment for checking a relation between the K-toner concentration [wt %] of the K-developer and the output voltage [V] from the toner-concentration detecting sensor. Specifically, at first, the developer conveying device 22K in which neither the fin member (29K) nor the dome member (39K) is provided, as shown in FIG. 19, was prepared. Then, a K-developer that was adjusted to have a predetermined K-toner concentration by mixing a K-toner and a magnetic carrier was set in the developer conveying device 22K. Then, the K-developer was idle agitated due to a rotation of the first screw member 26K or a second screw member 32K. An output voltage from the toner-concentration detecting sensor after the lapse of three minutes from the idle-agitation start time was defined as a standard sensor-output voltage Vts. The reason why the output voltage from the toner-concentration detecting sensor as for the K-developer after the lapse of three minutes from the idle-agitation start time was defined as the standard sensor-output voltage Vts is, as shown in FIG. 13, after the lapse of three minutes, a rapid degradation of the bulk density of the K-developer is substantially stopped, and also the K-toner is frictionally charged sufficiently. The measurement of the standard sensor-output voltage Vts was performed with respect to each of three K-developers which K-toner concentrations are 6, 8, and 10 [wt %] respectively. Then, regression analyses of the three K-developers were performed based on each of the K-toner concentrations and the standard sensor-output voltage Vts, and then a regression line equation indicating the relation between the K-toner concentration and the output voltage from the toner-concentration detecting sensor was obtained. Namely, in the K-developer after the lapse of three minutes from the idle-agitation start time, the K-toner concentration and the output voltage from the toner-concentration detecting sensor indicated a characteristic of the regression line equation. In the actual device, if the K-developer inside the first conveyance chamber constantly indicates the same condition as that is after the lapse of three minutes from the idle-agitation start time, the toner concentration can be accurately measured based on the regression line equation. However, for example, if an image which image-area ratio is low is continuously output, an output voltage from the toner-concentration detecting sensor is detected lower than an actual value (i.e., the toner concentration is detected higher than an actual amount) due to the degradation of the bulk density of the K-developer that is caused by an excessive agitation. As a result, the toner concentration of the K-developer is controlled by a lower amount than a proper amount, and thus a deficiency in the image density occurs.

Therefore, the present inventors subsequently carried out an experiment for checking a relation between a pressing force on the K-developer with respect to the K-toner-concentration detecting sensor 45K and an erroneously-detected toner-concentration amount. Specifically, in the test device explained above, the pressing force is changed under each of conditions 1 to 4. Under the condition 1, neither the fin member (29K) nor the dome member (39K) is provided. Under the condition 2, the fin member is provided, but the dome member is not provided. Under the condition 3, both the fin member and the dome member are provided. Under the condition 4, the dome member is provided, and also the fin member is provided on the rotating shaft member 27K in a protruding manner with tilting to the rotation axis direction so that the K-developer can be conveyed in a reverse direction from the spiral blade (28K) (hereinafter, the fin member is referred to as "the reversed fin"). Under the condition 4, the K-developer, which is conveyed in an opposite direction along a rotation axis in the area facing the load receiving plate (90), is pressed towards the load receiving plate (90) in accordance with the rotation of the fin member by being jarred among the K-developer, so that the highest pressing force on the K-developer with respect to the load receiving plate 90 can be obtained among the conditions.

Under each of the conditions, at first, the pressing force was measured. Then, after the combination of the load receiving plate (90) and the ultrasmall-capacity load cell (91) was replaced with the K-toner-concentration detecting sensor (45K), an idle agitation was started. Then, output voltages from the toner-concentration detecting sensor those obtained after the lapse of three minutes and the lapse of forty minutes from the idle-agitation start time were measured, and toner concentrations corresponding to the output voltages respectively were obtained by using the regression line equation. Then, a difference between the toner concentrations (a concentration difference) was obtained. Such the measurement of the concentration difference was performed with respect to each of three K-developers which K-toner concentrations were 6, 8, and 10 [wt %] respectively under each of the conditions. Then, an average under each of the conditions was defined as the erroneously-detected toner-concentration amount.

The reason why the difference between the calculated amount of the K-toner concentration after the lapse of three minutes from the idle-agitation start time and that is after the lapse of forty minutes from the idle-agitation start time was defined as the erroneously-detected toner-concentration amount is explained below. The degradation of the bulk density due to the idle agitation of the developer left for a long time reaches a point of saturation eventually. After the lapse of forty minutes from the idle-agitation start time, it reaches approximately eighty percent of the point of saturation. In the actual device, when an image which image-area ratio is low is continuously printed out, the agitation (a rotary drive of the screw member) is performed for a relatively long time in such a condition that an amount of toner consumption per unit time due to the development is relatively low, so that it falls in a state close to the idle agitation. Therefore, with the increase of the number of continuous printing, the bulk density of the developer is degraded as compared with that is at the time of steady printing, which results in a higher rate of an occurrence of an erroneous detection of the toner concentration. However, it is not the idle agitation, so that when the toner included in the developer is consumed due to the development, the developer is gradually refilled with new developer depending on the consumed amount, and thus the bulk density is not degraded up to the point of saturation. Even when an image which image-area ratio is very low is continuously printed out, the degradation of the bulk density is approximately eighty percent of the point of saturation. In other words, when an image which image-area ratio is low is continuously printed out by the actual device, the bulk density is gradually degraded; however, the bulk density is degraded to an equivalent amount with that is of the developer that is idle agitated for forty minutes. This is the reason why the difference between the calculated amount of the K-toner concentration after the lapse of three minutes from the idle-agitation start time and that is after the lapse of forty minutes from the idle-agitation start time was defined as the erroneously-detected toner-concentration amount.

Figure 25:
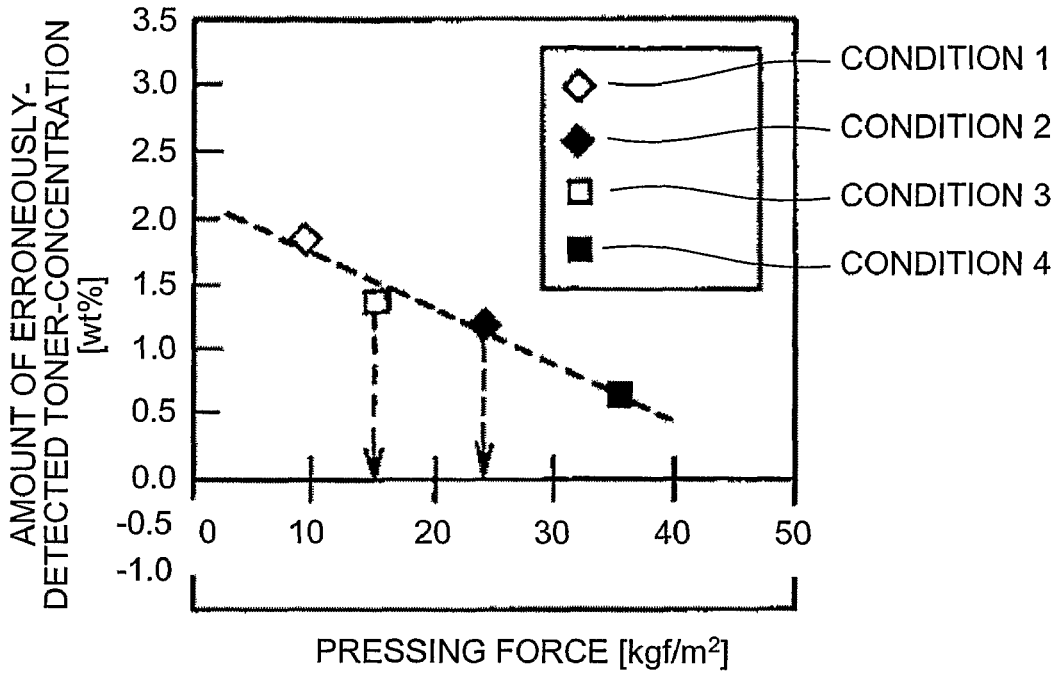
FIG. 25 is a graph showing a relation between an erroneously-detected toner-concentration amount and the pressing force.

FIG. 25 is a graph showing the relation between the erroneously-detected toner-concentration amount and the pressing force, which was obtained by the experiment. The erroneously-detected toner-concentration amount is preferably kept at 1.5 [wt %] or less. The reason is explained below. In a conventional technology, a toner having about 6.8 [μm] of an average particle diameter (ϕ) is generally used. In this case, when a toner concentration of the developer exceeds 12 [wt %], there are problems such as toner scattering, an image with white spots, and an adhesion of a carrier. Therefore, it is necessary to control the toner concentration to be 12 [wt %] or less. Also, when the toner concentration drops below 5 [wt %], there are problems such as a deficiency in a concentration of a solid image and an adhesion of a carrier. Therefore, it is necessary to control the toner concentration to be 5 [wt %] or more. To control the toner concentration surely within the range of 5 to 12 [wt %], the erroneously-detected toner-concentration amount needs to be estimated. In the conventional technology, the maximum amount of the erroneously-detected toner-concentration amount is usually approximately 3 [wt %]. Therefore, an upper limit and a lower limit of a target controlled amount of the toner concentration are generally set at 9 [wt %] as an upper-limit target amount and 8 [wt %] as a lower-limit target amount in anticipation of an error at 3 [wt %] respectively. However, with the progress of the high-resolution technique in recent years, there is a tendency to use a toner having a smaller particle diameter. If a toner having 5.5 [μm] of an average particle diameter (ϕ) is used, when a toner concentration exceeds 9 [wt %], there are problems such as toner scattering, an image with white spots, and an adhesion of a carrier. Furthermore, when the toner concentration drops below 5 [wt %], there are problems such as a deficiency in a concentration of a solid image and an adhesion of a carrier. In this case, when an error at 3 [wt %] is anticipated, an upper-limit target amount becomes 6 [wt %], and a lower-limit target amount becomes 8 [wt %]. Therefore, the upper-limit target amount is lower than the lower-limit target amount, so that the toner concentration cannot be controlled appropriately. This is the reason why the erroneously-detected toner-concentration amount is kept at 1.5 [wt %] or less. Consequently, even when the toner having 5.5 [μm] of the average particle diameter is used, the upper-limit target amount is 7.5 [wt %], and the lower-limit target amount is 6.5 [wt %]. Thus, the toner concentration can be controlled appropriately.

As shown in the graph in FIG. 25, when the pressing force exceeds 15 [kgf/m$^2$] (=9.8×15N/m$^2$), the erroneously-detected toner-concentration amount can be kept at 1.5 [wt %] or less. The present inventors confirmed that when a behavior of the K-developer near the K-toner-concentration detecting sensor 45K was taken at high speed with a high-sensitive camera, a shuffle of the K-developer near the sensor due to a rotation of the first screw member 26K was not activated under the condition that the pressing force was set at about 10 [kgf/m$^2$]. On the other hand, under the condition that the pressing force was set at 15 [kgf/m$^2$] or more, it was confirmed that the K-developer could be shuffled actively near the sensor due to the rotation of the first screw member 26K. Consequently, when the pressing force (the maximum amount of the pressing force by each one rotation of the screw) is set at 15 [kgf/m$^2$] or more, an occurrence of an erroneous detection of the toner-concentration due to a fluctuation in the toner bulk can be reduced as compared with that is in the conventional technology, and also a change of the toner concentration can be detected promptly by shuffling the developer near the toner-concentration detecting sensor actively.

However, the pressing force (the maximum amount of the pressing force by each one rotation of the screw) needs to be set at 100 [kgf/m$^2$] (=9.8×100N/m$^2$) or less. The reason is explained below. The present inventors carried out an additional experiment for checking a relation between the pressing force and the erroneously-detected toner-concentration amount by increasing the pressing force from 9.8×50 [N/m$^2$] to 9.8×180 [N/m$^2$] gradually. It was found that when the pressing force exceeds about 9.8×100 [N/m$^2$], the erroneously-detected toner-concentration amount starts increasing drastically. This is the reason why the pressing force was kept at 9.8×100 [N/m$^2$] or less. As a result, it is possible to prevent such the situation that the erroneously-detected toner-concentration amount was rather increased by increasing the pressing force excessively.

The reason why the erroneously-detected toner-concentration amount starts increasing drastically when the pressing force exceeds about 9.8×100 [N/m$^2$] is explained below. When the pressing force exceeds about 9.8×100 [N/m$^2$], a pressure applied to the developer below the dome member increases excessively, so that the developer located in the downstream side of the dome member in a conveying direction cannot enter below the. Then, a circulatory state of the developer is different from that is as usual, for example, in such a manner that the developer crosses over the dome member. As a result, the developer is not shuffled actively near the detecting surface of the toner-concentration detecting sensor, and thereby increasing the erroneously-detected amount. Furthermore, when the pressure applied to the developer increases excessively below the dome member, a rotational movement of the first screw member is locked due to the pressure, and then it may cause damage on the unit.

When a straight line in the graph shown in FIG. 25 is extended to a horizontal axis, an intercept between the horizontal axis and the straight line is located around 50 [kgf/m$^2$]. At this time, in theory, the erroneously-detected toner-concentration amount is nearly zero [wt %]. In these experiments in which the pressing force was set within the range of 50 to 180 [kgf/m$^2$] (9.8×50 to 100 N m$^2$), under the condition that the pressing force was set equal to or slightly higher than 50 [kgf/m$^2$] as an initial amount, the erroneously-detected toner-concentration amount could be also nearly zero [wt %].

In the copying machine according to the embodiment, an average of the maximum amounts of the pressing force on the developer, which is conveyed inside the first conveyance chamber in accordance with the rotation of the first screw member as the developer conveying unit of each of the process units 10Y, 10C, 10M, and 10K, with respect to the toner-concentration detecting sensor by each one rotation of the screw or an average of the maximum amounts of the pressing force on the developer with respect to the wall provided between the developer and the toner-concentration detecting sensor by each one rotation of the screw is set within the range of 9.8×15 [N/m$^2$] to 9.8×100 [N/m$^2$].

The maximum amounts of the pressing force on the developer with respect to the toner-concentration detecting sensor by each one rotation of the screw are, as shown in FIG. 24, amounts at each peak of the mountain-like waveform that appears periodically by each one rotation of the screw. As for the measurement of the pressing force, the pressing force may indicate an extremely larger amount than the actual amount due to incorporation of noise; however, the extremely larger amount (hereinafter, referred to as "the local maximal amount due to noise") is not the correct pressing force, so that the local maximal amount due to noise needs to be eliminated from results of the measurement. Without using a noise filter, the local maximal amount due to noise can be eliminated by various generally well-known methods as follows. For example, the pressing force is measured via an electronic low-pass filter, or a few points of a moving average is applied to an amount read by the toner-concentration detecting sensor, or an amount different from that of the moving average by more than predetermined points is eliminated. In the toner-concentration detecting sensor including the permeability sensor, there is no harm in eliminating a periodical waveform appearing at high period, which is more than ten-times higher with respect to the period of one rotation of the screw, as the noise. The important thing is to apprehend a change of the pressure corresponding to the rotation period of the agitating member (such as the screw member) located around the detecting surface of the sensor so as to grasp the maximum amount of the pressure. The periodical waveform at more than ten-times higher period or a suddenly-appeared (spike) waveform is unrelated to the pressing force on the developer conveyed by the first screw member with respect to the toner-concentration detecting sensor, so that it does not indicate a result of the detection of the pressing force by the toner-concentration detecting sensor even though the toner-concentration detecting sensor outputs the result. Therefore, the local maximal amount of the waveform does not correspond to "the maximum amount of the pressing force with respect to the toner-concentration detecting unit by each one rotation of the agitation conveying member" according to the present invention.

The average of the maximum amounts of the pressing force by each one rotation of the screw is obtained in such a manner that the maximum amount by each one rotation of the screw is measured for the number of next rotations, and an average of the measured number of the maximum amounts is calculated. The measured number is the number of rotations of the screw in a period in which the developer is circulated from the first conveyance chamber to the second conveyance chamber just five times (five laps from the first conveyance chamber to the second conveyance chamber). If the dome member is provided, the maximum amount may increase gradually after the agitation is started. According to the experiment performed by the present inventors, when the increase was not stopped within the period, the developer was stuck in the dome member soon after the period. On the other hand, when the increase was stopped within the period, and also the maximum amounts were stable in a certain level, the developer was not stuck in the dome member. Consequently, "the average of the maximum amounts of the pressing force on the developer by each one rotation of the agitation conveying member" according to the present invention denotes the average of the maximum amounts within the period only when the maximum amounts of the pressing force are stable within a certain range after the increase of the pressing force is stopped within the period. As for the measurement of "the pressing force", a brand-new magnetic carrier is to be used. As for the agitation of the developer, the idle agitation is to be performed without refilling toner.

Furthermore, it is still difficult to obtain 9.8×15 [N/m$^2$] or more of the pressing force even though the toner-concentration detecting sensor is arranged around the first screw member in which the fin member is not provided. However, sorts of ingenuities can make it possible to obtain such the pressing force. For example, the pressing force can be increased higher than usual in such a manner that the fin member (29K) as shown in FIG. 22 or the reversed fin as described above is provided on, out of a whole area of the rotating shaft member of the first screw member in the rotation axis direction, an area facing the toner-concentration detecting sensor. When 9.8×15 [N/m$^2$] or more of the pressing force cannot be obtained even though the fin member or the reversed fin is provided, the dome member 39K as shown in FIG. 23 is further provided. In the copying machine according to the embodiment, both the reversed fin and the dome member are provided.

Examples of the copying machine according to the embodiment to which more-characteristic configurations are added are explained below. Copying machines according to the examples respectively have the same configuration as that is of the copying machine according to the embodiment, if not otherwise specified.

In a copying machine according to a first example, there is used the developer conveying unit of each of the process units (10Y, 10C, 10M, and 10K) capable of setting an average of the maximum amounts of the pressing force on the developer conveyed inside the first conveyance chamber in accordance with the rotation of the first screw member by each one rotation of the screw with respect to the toner-concentration detecting sensor or an average of the maximum amounts of the pressing force on the developer by each one rotation of the screw with respect to the wall provided between the developer and the toner-concentration detecting sensor at 9.8×25 [N/m$^2$] or more.

Figure 26:
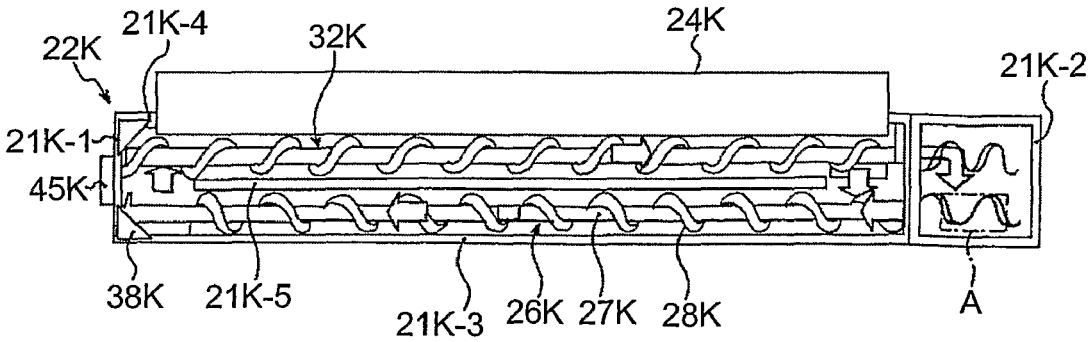
FIG. 26 is an exploded plane view of a K-developer conveying device viewed from above, which is included in a copying machine according to a second example.

FIG. 26 is an exploded plane view of the K-developer conveying device 22K viewed from above, which is included in a copying machine according to a second example. The developer conveying devices for other colors have the same configuration as that is of the K-developer conveying device 22K. A screw member such as the first screw member 26K can pressurize the developer being conveyed firmly in a conveying direction or in a delivering direction. In this case, the conveying direction is the same direction as a rotation axis direction of the screw member, and the delivering direction denotes an ejecting direction of the developer ejected from an end portion in the downstream side of the screw member in the developer-conveying direction. For example, if the screw member is arranged in a space on a not-curved straight line, the ejecting direction of the developer ejected from the end portion of the screw member in the downstream side is the same direction as the rotation axis direction. On the other hand, if the screw member is arranged in the front side of a curved portion or a bent portion of a space, which is curved or bent in mid-course, the ejecting direction of the developer ejected from the space where the screw is contained to the curved portion or the bent portion is a direction along a curved surface of the curved portion or a bent surface of the bent portion. The screw member can pressurize the developer firmly in these directions.

However, it is difficult for the screw member to pressurize the developer firmly in a normal direction. Therefore, in the copying machine according to the embodiment, the fin member, the reversed fin, or the like is provided to increase the pressing force in the normal direction. This is because the toner-concentration detecting sensor is arranged to detect the toner concentration of the developer conveyed in the normal direction.

On the other hand, in the copying machine according to the second example, the K-toner-concentration detecting sensor 45K is arranged in such a manner that a toner-concentration detecting surface of the K-toner-concentration detecting sensor 45K is extended in a direction of a surface perpendicular to the rotation axis direction of the first screw member 26K. Then, the toner-concentration detecting surface of the K-toner-concentration detecting sensor 45K (or a wall provided between the toner-concentration detecting surface and the K-developer) is set to strike on the K-developer delivered from the first screw member 26K. More specifically, the K-developer is passed from the first conveyance chamber containing the first screw member 26K to the second conveyance chamber containing the second screw member 32K through the opening provided on the partition wall 21Y-5. Therefore, a developer conveying path is curved in a horizontal direction between the first and second conveyance chambers. Then, when the developer conveying path is curved in the horizontal direction, the conveying direction of the K-developer from the first conveyance chamber is always a surface direction along the rotation axis direction of the first screw member 26K. More specifically, for example, in the present copying machine, the first screw member 26K is arranged in such a manner that the rotation axis is set along a horizontal surface. In this case, the conveying direction of the K-developer from the first conveyance chamber is always a direction along the horizontal surface. Which direction on the horizontal surface is determined depending on the curved surface of the curved portion. In the copying machine according to the embodiment, a curved surface (a surface of a rear-side plate 21K-1) is perpendicular to the rotation axis direction of the first screw member 26K, so that the conveying direction of the K-developer is curved at 90 degrees on the horizontal surface. On the other hand, in the copying machine according to the second example, a triangular-prism like curve-angle adjusting member 38K is fixed on the end portion of the first conveyance chamber in the downstream side of the developer conveying direction, and then a curve angle on the horizontal surface is set at 45 degrees. Then, the K-developer delivered from the first conveyance chamber is set to be struck on the horizontal surface at 45 degrees with respect to the rear-side plate 21K-1. Consequently, even though the fin member or the dome member is not provided, the K-developer delivered from the first conveyance chamber can be struck and pressed firmly on the toner-concentration detecting surface of the K-toner-concentration detecting sensor 45K (or the rear-side plate 21K-1).

In this manner, the toner-concentration detecting sensor is arranged in such a manner that the toner-concentration detecting surface is extended to the surface direction perpendicular to the rotation axis direction of the screw member, so that the developer can be pressed firmly on the toner-concentration detecting surface (or the wall provided between the toner-concentration detecting surface and the developer) even though the fin member or the dome member is not provided.

When the toner-concentration detecting surface is extended to the surface direction perpendicular to the rotation axis direction of the screw member, the curved portion or the bent portion is not necessarily provided on the developer conveying path. For example, pitches in an axis direction of the spiral blade of the screw member are partially enlarged, and the toner-concentration detecting sensor is arranged between the blades which pitches are enlarged so that the developer conveyed between the blades can be directly struck on the toner-concentration detecting surface extended in the rotation axis direction of the toner-concentration detecting sensor[r]the screw member.

In this manner, in the copying machine according to the first example, the average of the maximum amounts of the pressing force by each one rotation of the screw is set at 9.8×25 [N/m$^2$] or more, and thus the erroneously-detected toner-concentration amount can be reduced as compared with in a case of setting at less than 9.8×25 [N/m$^2$].

Furthermore, in the copying machine according to the second example, the first screw member 26K, which conveys the K-developer in the rotation axis direction by agitating the K-developer in accordance with the rotation of the spiral blade 28K provided in the spirally-protruding manner on the perimeter surface of the rotatably-supported rotating shaft member 27K, is used as the agitation conveying member. Then, the K-toner-concentration detecting sensor 45K is arranged in such a manner that the toner-concentration detecting surface is extended to the surface direction perpendicular to the rotation axis direction of the first screw member 26K. In such the configuration, as described above, the developer can be pressed firmly on the toner-concentration detecting surface (or the wall provided between the toner-concentration detecting surface and the developer) even though the fin member or the dome member is not provided.

Furthermore, in the copying machine according to the embodiment, as the fin member or the dome member is provided, a developer-conveying speed in a toner-concentration detecting area where the K-toner-concentration detecting sensor 45K detects the toner concentration, out of a whole area of the first conveyance chamber as the developer conveying unit, is slowed down as compared with that is in other areas. In such the configuration, the bulk density of the developer in the toner-concentration detecting area is set higher than that is in the other areas, so that 9.8×15 [N/m$^2$] or more of the average of the maximum amounts can be easily obtained.

Furthermore, in the copying machine according to the embodiment, the fin member is provided in the first screw member 26K as the agitation conveying member, so that a developer-conveying performance in a portion corresponding to the toner-concentration detecting area, out of a whole area in the rotation axis direction of the fin member, is lowered as compared with that is in other portions. In such the configuration, the developer-conveying speed in the toner-concentration detecting area can be surely slowed down as compared with that is in other areas.

According to an aspect of the present invention, as revealed by the experiments performed by the present inventors, when the maximum amount of the pressing force on the developer with respect to the toner-concentration detecting unit, which has contact with the developer being conveyed, or the maximum amount of the pressing force on the developer with respect to the wall provided between the developer and the toner-concentration detecting unit is set at 9.8×15 [N/m$^2$] or more, the developer subject to a detection of the toner concentration, which is a portion of the developer contained in the developer conveying unit, can be pressurized enough to prevent an occurrence of an erroneous detection of the toner concentration. Furthermore, the developer can be actively shuffled near the toner-concentration detecting unit in accordance with a rotation of the agitation conveying member. As a result, an occurrence of an erroneous detection of the toner concentration due to a fluctuation in toner bulk can be reduced as compared with that is in the conventional technology, and also a change of the toner concentration can be detected promptly by shuffling the developer actively near the toner-concentration detecting unit. If the maximum amount is increased excessively, shuffling of the developer near the toner-concentration detecting unit is adversely inhibited. However, as revealed by the experiments, by setting the maximum amount at 9.8×100 [N/m$^2$] or less, active shuffling of the developer can be remained.

The invention claimed is:

1. A developing device comprising:

a developer conveying device configured to convey a developer containing a toner and a carrier; and a developer holding unit configured to convey the developer conveyed by the developer conveying device to an area facing a latent-image holding unit in accordance with its own surface movement by holding the developer on its own endlessly-moving surface, and develop a latent image held by the latent-image holding unit, wherein the developer conveying device includes:

a developer conveying unit configured to convey a developer containing a toner and a carrier in a rotation axis direction while agitating the developer with rotation of an agitation conveying member, and a toner-concentration detecting unit configured to detect a toner concentration of the developer by having contact with the developer conveyed inside the developer conveying unit or facing the developer via a wall of the developer conveying unit; and an average of maximum amounts of a pressing force on the developer, which is conveyed inside the developer conveying unit by the agitation conveying member, by each one rotation of the agitation conveying member with respect to the toner-concentration detecting unit or an average of maximum amounts of a pressing force on the developer by each one rotation of the agitation conveying member with respect to a portion of the wall facing the toner-concentration detecting unit is set within a range of 9.8×15 [N/m$^2$] to 9.8×100 [N/m$^2$].

2. The developing device according to claim 1, wherein the average of the maximum amounts is set at 9.8×25 [N/m$^2$] or more.

3. The developing device according to claim 1, wherein a screw member configured to convey the developer in the rotation axis direction while agitating the developer due to rotation of a spiral blade provided on a perimeter surface of a rotatably-supported rotating shaft member in a spirally-protruding manner is used as the agitation conveying member, and the toner-concentration detecting unit is arranged in a position in which a toner-concentration detecting surface is extended to a surface direction perpendicular to the rotation axis direction.

4. The developing device according to claim 1, wherein a developer-conveying speed in a toner-concentration detecting area where the toner-concentration detecting unit detects the toner concentration, which is a portion of a whole area of the developer conveying unit, is slowed down as compared with a developer-conveying speed in other areas.

5. The developing device according to claim 4, wherein in the agitation conveying member developer-conveying performance in a portion corresponding to the toner-concentration detecting area, which is a portion of a whole area of the agitation conveying member in the rotation axis direction, is lowered as compared with a developer-conveying performance in other portions.

6. A process unit that is integrally attached to a main body of an image forming apparatus including a latent-image holding unit configured to hold a latent image, a developing device configured to develop the latent image held on the latent-image holding unit, and a transfer unit configured to transfer a visualized image developed on the latent-image holding unit onto a transferred member, wherein at least the latent-image holding unit and the developing device are held, as one unit, in a common holding unit of the process unit and the image forming apparatus, and the developing device according to claim 1 is used as the developing device.

7. The process unit according to claim 6, wherein the average of the maximum amounts is set at 9.8×25 [N/m$^2$] or more.

8. The process unit according to claim 6, wherein a screw member configured to convey the developer in the rotation axis direction while agitating the developer due to rotation of a spiral blade provided on a perimeter surface of a rotatably-supported rotating shaft member in a spirally-protruding manner is used as the agitation conveying member, and the toner-concentration detecting unit is arranged in a position in which a toner-concentration detecting surface is extended to a surface direction perpendicular to the rotation axis direction.

9. The process unit according to claim 6, wherein a developer-conveying speed in a toner-concentration detecting area where the toner-concentration detecting unit detects the toner concentration, which is a portion of a whole area of the developer conveying unit, is slowed down as compared with a developer-conveying speed in other areas.

10. The process unit according to claim 9, wherein in the agitation conveying member developer-conveying performance in a portion corresponding to the toner-concentration detecting area, which is a portion of a whole area of the agitation conveying member in the rotation axis direction, is lowered as compared with a developer-conveying performance in other portions.

11. An image forming apparatus comprising:

a latent-image holding unit configured to hold a latent image; and a developing device configured to develop the latent image held on the latent-image holding unit, wherein the developing device according to claim 1 is used as the developing device.

12. The image forming apparatus according to claim 11, wherein the average of the maximum amounts is set at 9.8×25 [N/m$^2$] or more.

13. The image forming apparatus according to claim 11, wherein a screw member configured to convey the developer in the rotation axis direction while agitating the developer due to rotation of a spiral blade provided on a perimeter surface of a rotatably-supported rotating shaft member in a spirally-protruding manner is used as the agitation conveying member, and the toner-concentration detecting unit is arranged in a position in which a toner-concentration detecting surface is extended to a surface direction perpendicular to the rotation axis direction.

14. The image forming apparatus according to claim 11, wherein a developer-conveying speed in a toner-concentration detecting area where the toner-concentration detecting unit detects the toner concentration, which is a portion of a whole area of the developer conveying unit, is slowed down as compared with a developer-conveying speed in other areas.

15. The image forming apparatus according to claim 14, in the agitation conveying member developer-conveying performance in a portion corresponding to the toner-concentration detecting area, which is a portion of a whole area of the agitation conveying member in the rotation axis direction, is lowered as compared with a developer-conveying performance in other portions.

* * * * *